US010984968B2

(12) United States Patent
Su et al.

(10) Patent No.: US 10,984,968 B2
(45) Date of Patent: Apr. 20, 2021

(54) KEYSWITCH STRUCTURE

(71) Applicant: DARFON ELECTRONICS CORP., Taoyuan (TW)

(72) Inventors: Cheng-Min Su, Taoyuan (TW); Chin-Lung Chan, Taoyuan (TW); Yu-Chih Chang, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/878,583

(22) Filed: May 19, 2020

(65) Prior Publication Data

US 2020/0373105 A1 Nov. 26, 2020

(30) Foreign Application Priority Data

May 22, 2019 (TW) ..... 108117635
Sep. 11, 2019 (TW) ..... 108132678

(51) Int. Cl.

| | |
|---|---|
| ***H01H 3/12*** | (2006.01) |
| ***H01H 13/14*** | (2006.01) |
| ***H01H 13/04*** | (2006.01) |
| ***H01H 13/20*** | (2006.01) |

(52) U.S. Cl.

CPC ..... *H01H 13/14* (2013.01); *H01H 3/12* (2013.01); *H01H 13/04* (2013.01); *H01H 13/20* (2013.01); *H01H 2233/04* (2013.01)

(58) Field of Classification Search

CPC .... H01H 3/125; H01H 13/14; H01H 13/7065; H01H 13/705; H01H 13/70; H01H 3/12; H01H 15/16; H01H 2237/00; H01H 13/20; H01H 13/50

See application file for complete search history.

(56) References Cited

U.S. PATENT DOCUMENTS

| | | | | |
|---|---|---|---|---|
| 9,941,070 | B2 * | 4/2018 | Liu | H01H 13/7006 |
| 10,184,609 | B2 * | 1/2019 | Yen | F16M 13/02 |
| 2004/0074753 | A1 * | 4/2004 | Chen | H01H 3/125 200/344 |

(Continued)

FOREIGN PATENT DOCUMENTS

| | | |
|---|---|---|
| CN | 102969183 A | 3/2013 |
| CN | 104576136 B | 7/2017 |

(Continued)

*Primary Examiner* — Ahmed M Saeed
(74) *Attorney, Agent, or Firm* — Winston Hsu

(57) ABSTRACT

A keyswitch structure includes a base plate, a keycap, and two supports connected to the base plate and the keycap. The keycap is movable relative to the base plate through the two supports. In an embodiment, the support is pivotally connected to the base plate through a pivotal connection structure that includes a guiding slot and a protruding shaft oppositely disposed on the support and the base plate. The guiding slot has an indentation portion and can guide the protruding shaft to fit in the indentation portion. In another embodiment, the support includes a support body connected to the base plate, and an abutting arm extending from the support body. The base plate structurally constrains the support through a hook and a limitation post thereof. The abutting arm of one support extends under the other support, so that the two supports can move each other through the abutting arms.

14 Claims, 28 Drawing Sheets

(56) References Cited

U.S. PATENT DOCUMENTS

| | | | | |
|---|---|---|---|---|
| 2012/0312670 | A1* | 12/2012 | Jhuang | H01H 13/83<br>200/314 |
| 2013/0078023 | A1 | 3/2013 | Yamada | |
| 2016/0351349 | A1 | 12/2016 | Chen | |

FOREIGN PATENT DOCUMENTS

| | | | |
|---|---|---|---|
| TW | 201611064 | A | 3/2016 |
| TW | 201724147 | A | 7/2017 |

* cited by examiner

KEYSWITCH STRUCTURE

BACKGROUND OF THE INVENTION

1. Field of the Invention

The present invention relates to a mechanical keyswitch structure, and more particularly to a mechanical keyswitch, of which a keycap is supported by and moves through two supports.

2. Description of the Prior Art

Conventional keyswitch structures have a larger size and occupy larger disposition space, which is conducive to its design flexibility, for example, using more components, using more complex structures, and so on. However, when the keyswitch structure is small in size (or the disposition space is small, e.g. for thin keyswitch structures), the component amount, the structural complexity and so on are constrained. Furthermore, the supports of the conventional keyswitch structures usually use hole and shaft to mate. During assembly, in principle, the supports need to be elastically deformed for connecting with each other or assembling to a keycap and a base plate of the keyswitch structure, however, which may induce some permanent deformation of the components. Furthermore, when the keyswitch structure is small in size, in addition to the inconvenience of the assembly of the components, if the component is slightly permanently deformed after assembly, the above connection will obviously affect the structural stability or smoothness of the operation of the keyswitch structure. If the situation is worse, the assembly will fail, the product yield decreases, and the production costs increases.

SUMMARY OF THE INVENTION

The present invention provides a keyswitch structure, which uses a guiding structure for convenience of assembling a support with a base plate of the keyswitch structure.

A keyswitch structure according to the present invention includes a base plate, a keycap, a support, and a pivotal connection structure. The keycap is disposed above the base plate. The support is connected to the keycap. The support is connected to the base plate through the pivotal connection structure, so that the support is rotatable relative to the base plate around a rotation axis. The pivotal connection structure includes a guiding slot and a protruding shaft. The guiding slot extends perpendicular to the rotation axis and has an opening and an indentation portion. The indentation portion is recessed parallel to the rotation axis. The guiding slot is disposed on one of the support and the base plate. The protruding shaft rotatably fits in the indentation portion relative to the rotation axis. The protruding shaft is disposed on the other of the support and the base plate opposite to the guiding slot. The keycap is up and down movable relative to the base plate through the support. Thereby, the guiding slot helps the protruding shaft to fit in the indentation portion, which can effectively reduce or avoid structural deformation after assembly.

Another objective of the invention is to provide a keyswitch structure, of which two supports disposed oppositely have an extending structure extending under the other support so as to move each other. The supports are assembled to a base plate of the keyswitch structure through a hook and a limitation post.

A keyswitch structure according to the present invention includes a base plate, a keycap, a first support, and a second support. The base plate includes a first hook, a first limitation post, a second hook, and a second limitation post. The keycap is disposed above the base plate. The first support includes a first support body and a first abutting arm extending from the first support body. The first support is connected to and between the keycap and the base plate through the first support body. The first support body has a first base plate abutting portion and a first limitation hole. The first base plate abutting portion abuts against the base plate. The first support body is rotatable relative to the base plate through the first base plate abutting portion. The first hook hooks the first base plate abutting portion. The first limitation post extends into the first limitation hole. The second support includes a second support body and a second abutting arm from the second support body. The second support body is connected to and between the keycap and the base plate through the second support body. The second support body has a second base plate abutting portion and a second limitation hole. The second base plate abutting portion abuts against the base plate. The second support body is rotatable relative to the base plate through the second base plate abutting portion. The second hook hooks the second base plate abutting portion. The second limitation post extends into the second limitation hole. The first abutting arm is located between the second support body and the base plate and abuts against the second support body. The second abutting arm is located between the first support body and the base plate and abuts against the first support body. Thereby, by the simple structural logic of the first support body and the second abutting arm abutting against each other and the second support body and the first abutting arm abutting against each other, the first support and the second support can move each other. Furthermore, by the simple structural logic of the first hook and the first limitation post structurally constraining the first support body and the second hook and the second limitation post structurally constraining the second support body, the connection of the first support and the second support with the base plate can be achieved.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
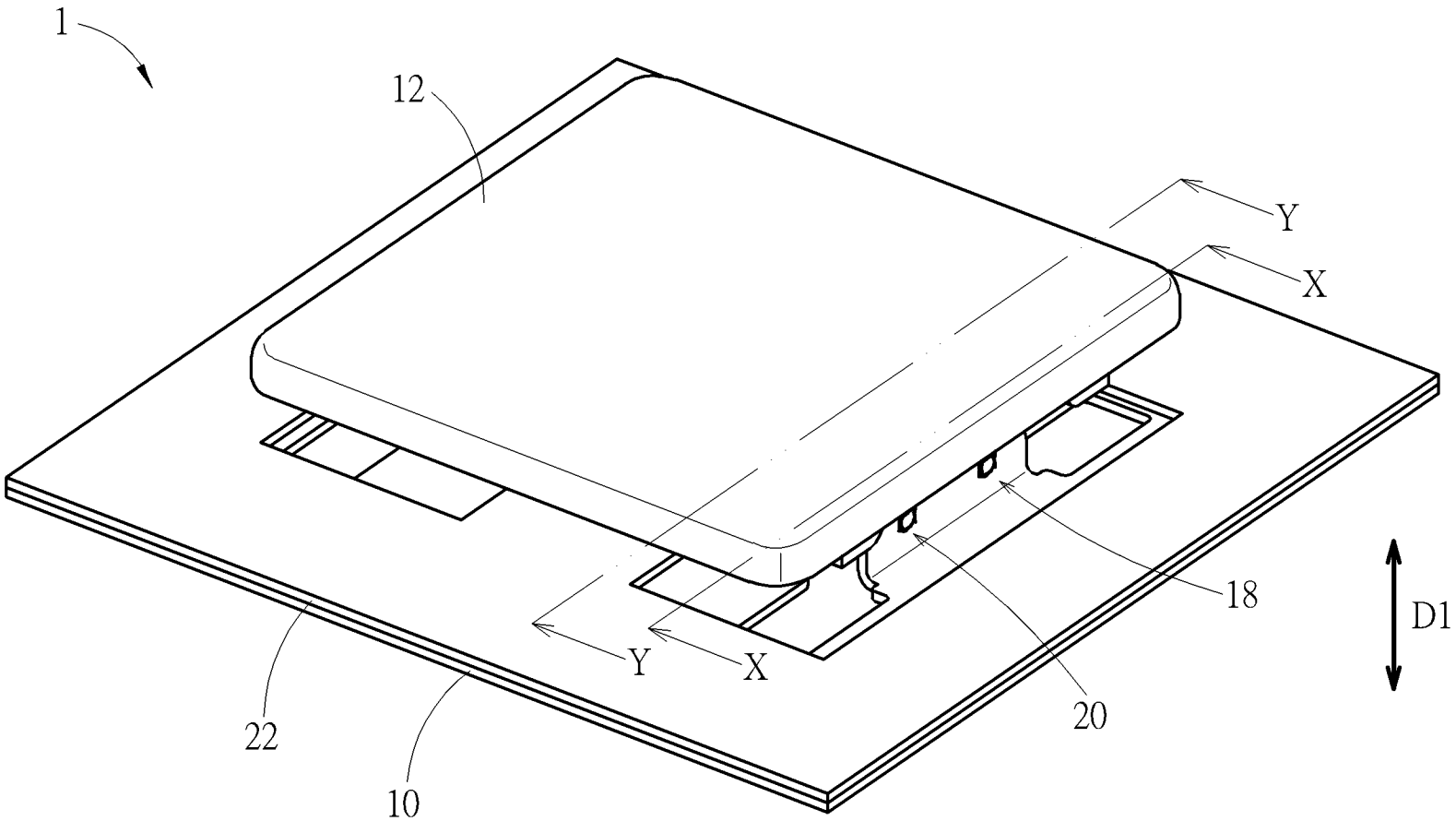
FIG. 1 is a schematic diagram illustrating a keyswitch structure according to an embodiment.
Figure 2:
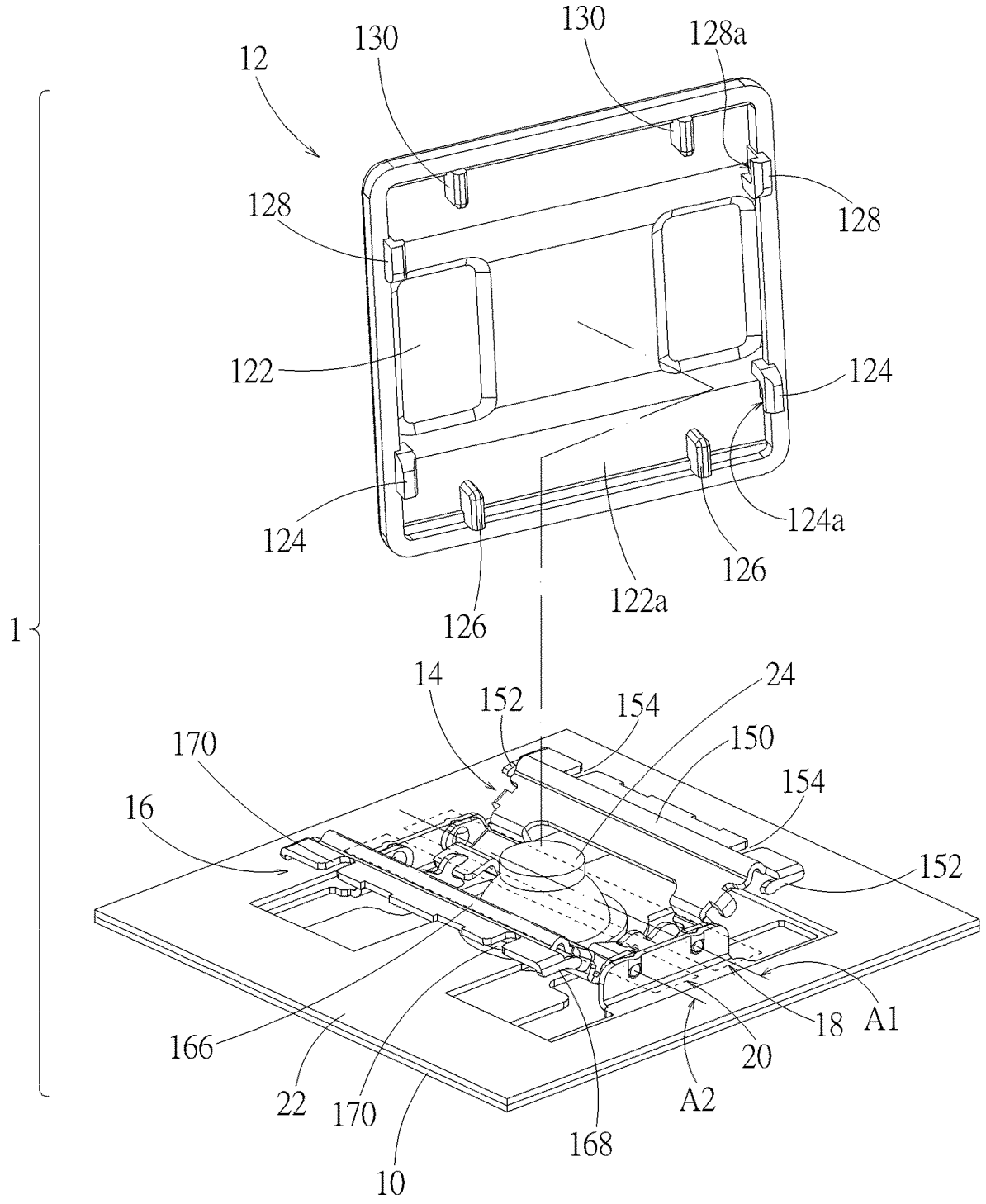
FIG. 2 is a partially exploded view of the keyswitch structure in FIG. 1.
Figure 3:
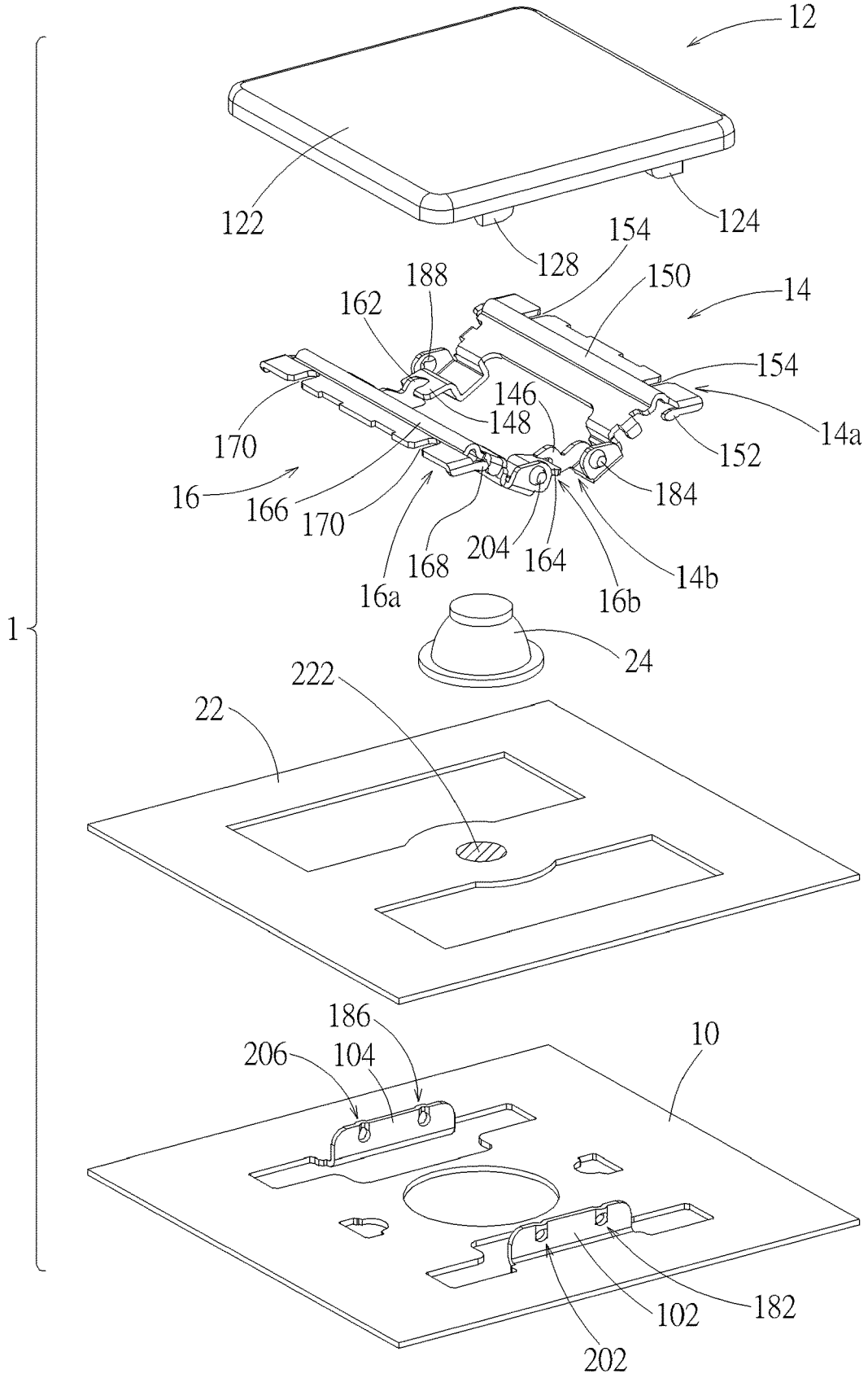
FIG. 3 is an exploded view of the keyswitch structure in FIG. 1.

Please refer to FIG. 1 to FIG. 3. A keyswitch structure 1 according to an embodiment includes a base plate 10, a keycap 12, a first support 14, a second support 16, a first pivotal connection structure 18 (shown in dashed lines in FIG. 2), a second pivotal connection structure 20 (shown in dashed lines in FIG. 2), a switch circuit board 22 and a resilient restoration part 24. The keycap 12 is disposed above the base plate 10. The first support 14 and the second support 16 is connected to and between the keycap 12 and the base plate 10. Therein, the first support 14 is connected to the base plate 10 through the first pivotal connection structure 18, so that the first support 14 can rotate relative to the base plate 10 around a first rotation axis A1 (indicated by a chain line in FIG. 2). The first support 14 has two opposite sides 14*a* and 14*b* relative to the first rotation axis A1. The first support 14 is connected to the keycap 12 through one side 14*a* and is engaged with the second support 16 through the other side 14*b*. The second support 16 is connected to the base plate 10 through the second pivotal connection structure 20, so that the second support 16 can rotate relative to the base plate 10 around a second rotation axis A2 (indicated by a chain line in FIG. 2). The second support 16 has two opposite sides 16*a* and 16*b* relative to the second rotation axis A2. The second support 16 is connected to the keycap 12 through one side 16*a* and is engaged with the first support 14 through the other side 16*b*. The first rotation axis A1 and the second rotation axis A2 are parallel. The switch circuit board 22 is disposed on the base plate 10 and includes a switch 222 (shown by a circle with hatched lines in FIG. 3). The resilient restoration part 20 is disposed on the switch circuit board 22 corresponding to the switch 222. Thereby, the keycap 12 can move parallel a vertical direction D1 (i.e. move up and down) relative to the base plate 10 through the first support 14 and the second support 16. When moving downward, the keycap 12 can compress the resilient restoration part 24 to trigger the switch 222. In practice, the switch circuit board 22 can be but not limited to a conventional membrane circuit board, and the structural details thereof will not be described in addition. For simplification of drawing, the switch circuit board 22 still is shown by a single solid part. The resilient restoration part 24 can be but not limited to a silicon or rubber dome.

Figure 4:
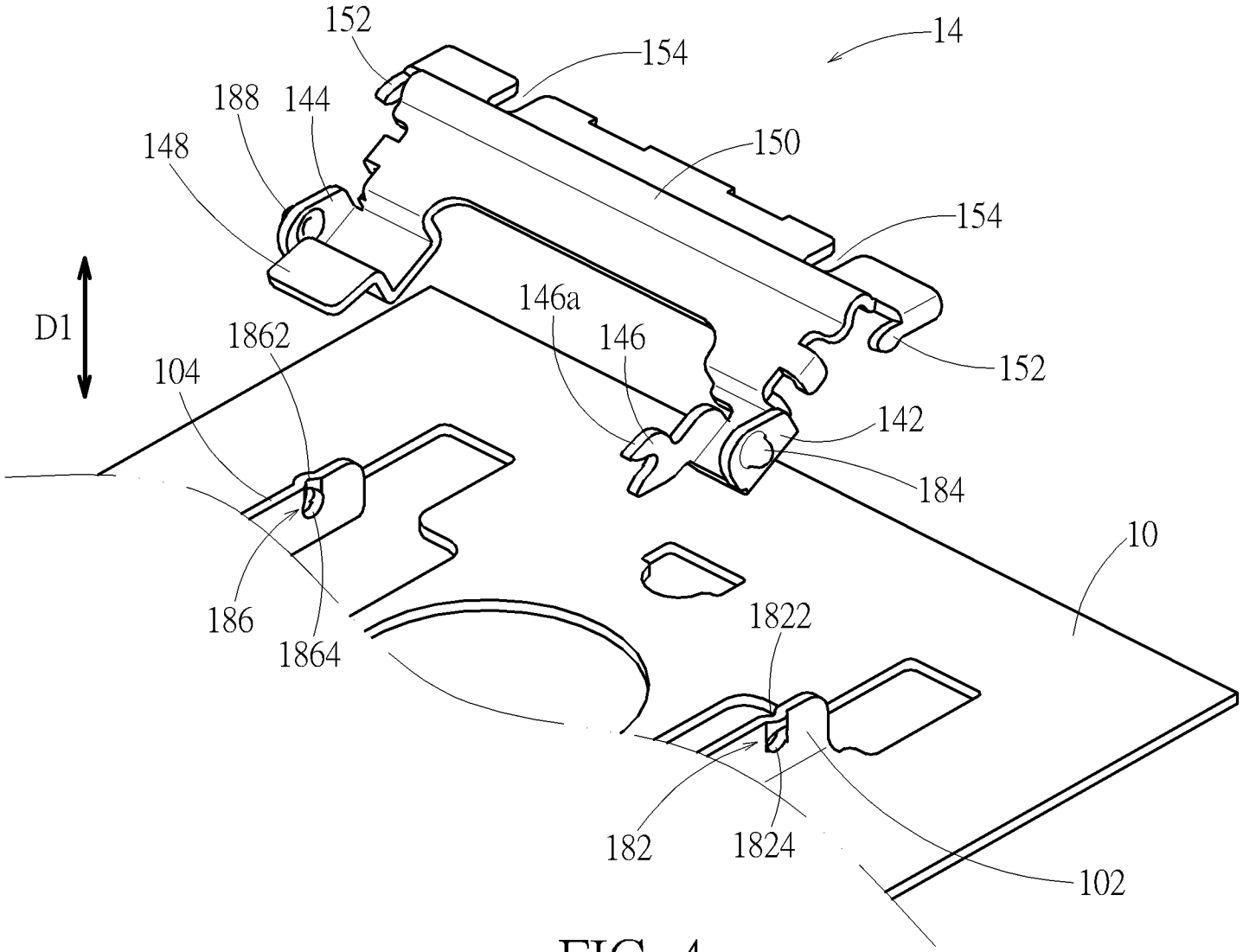
FIG. 4 is an exploded view of a first pivotal connection structure in FIG. 2.
Figure 5:
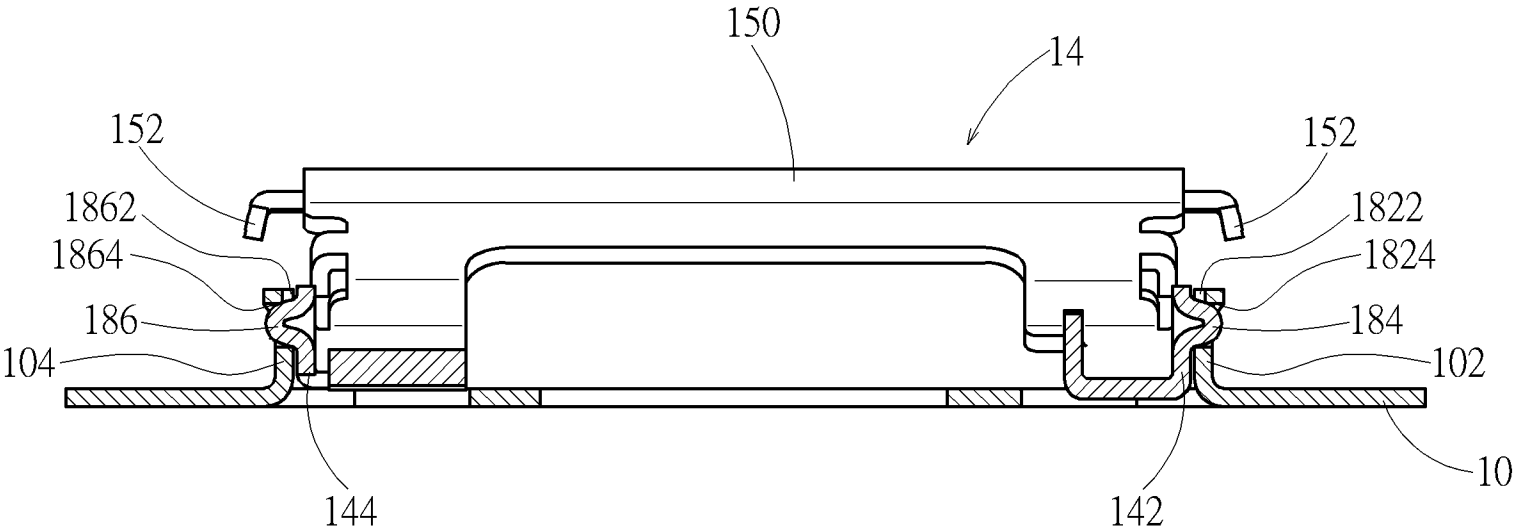
FIG. 5 is a sectional view of a first support, a base plate, and the first pivotal connection structure, of which the cutting plane passes through a first rotation axis.

Please also refer to FIG. 4 and FIG. 5. The first pivotal connection structure 18 includes a first guiding slot 182, a first protruding shaft 184, a third guiding slot 186, and a third protruding shaft 188. The first guiding slot 182 extends perpendicular to the first rotation axis A1 and has a first opening 1822 and a first indentation portion 1824. The first indentation portion 1824 is recessed parallel to the first rotation axis A1. The first protruding shaft 184 rotatably fits in the first indentation portion 1824 relative to the first rotation axis A1. The third guiding slot 186 extends perpendicular to the first rotation axis A1 and has a third opening 1862 and a third indentation portion 1864. The third indentation portion 1864 is recessed parallel to the first rotation axis A1. The third protruding shaft 188 rotatably fits in the third indentation portion 1864 relative to the first rotation axis A1. In the embodiment, the first guiding slot 182 and the third guiding slot 186 are disposed on the base plate 10. The first protruding shaft 184 and the third protruding shaft 188 are disposed on the first support 14 opposite to the first guiding slot 182 and the third guiding slot 186. Thereby, the first support 14 is pivotally connected to the base plate 10 through the first pivotal connection structure 18, and therefore can rotate relative to the base plate 10 around the first rotation axis A1.

Furthermore, in the embodiment, the first guiding slot 182 and the third guiding slot 186 extend parallel to the vertical direction D1. The first opening 1822 and the third opening 1862 are located at the upper ends of the first guiding slot 182 and the third guiding slot 186. When the first support 14 is ready to be assembled to the base plate 10, the first protruding shaft 184 and the third protruding shaft 188 can enter the first guiding slot 182 and the third guiding slot 186 through the first opening 1822 and the third opening 1862 first. Then, the first support 14 can be pressed downward, so that the first protruding shaft 184 and the third protruding shaft 188 continuously slide downward in the first guiding slot 182 and the third guiding slot 186 until the first protruding shaft 184 and the third protruding shaft 188 fit in the first indentation portion 1824 and the third indentation portion 1864. At the moment, the pivotal connection of the first support 14 and the base plate 10 is achieved.

Furthermore, in the embodiment, two plate portions 102 and 104 extending upward from the base plate 10 form the first guiding slot 182 and the third guiding slot 186. In other words, the first guiding slot 182 and the third guiding slot 186 can be structurally integrated with the base plate 10 to be a single part (e.g. but not limited to by pressing a metal plate). The first indentation portion 1824 and the third indentation portion 1864 are provided respectively by a through hole (or by a recess in practice) and can be located at but not limited to distal ends (closed ends) of the first guiding slot 182 and the third guiding slot 186. The plate portions 102 and 104 respectively shows a cantilever plate that is elastic in principle, which helps the first protruding shaft 184 and the third protruding shaft 188 to elastically fit in the first indentation portion 1824 and the third indentation portion 1864 (by the guidance of the first guiding slot 182 and the third guiding slot 186). The first guiding slot 182 and the third guiding slot 186 still can keep in elastically contacting the first protruding shaft 184 and the third protruding shaft 188. Furthermore the first protruding shaft 184 and the third protruding shaft 188 protrude laterally from two cantilever plates 142 and 144 at two sides of the first support 14 respectively. The cantilever plates 142 and 144 respectively show a cantilever structure and are elastic in principle, which also is conducive to the above elastically fitting and elastically contacting.

Figure 6:
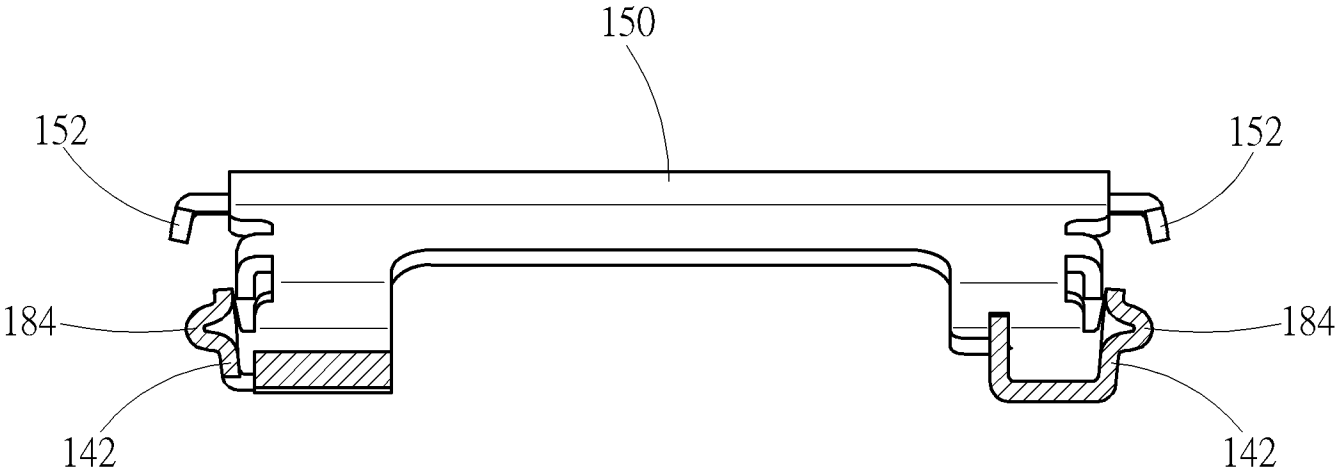
FIG. 6 is a sectional view of the first support in FIG. 5 according to another embodiment.
Figure 7:
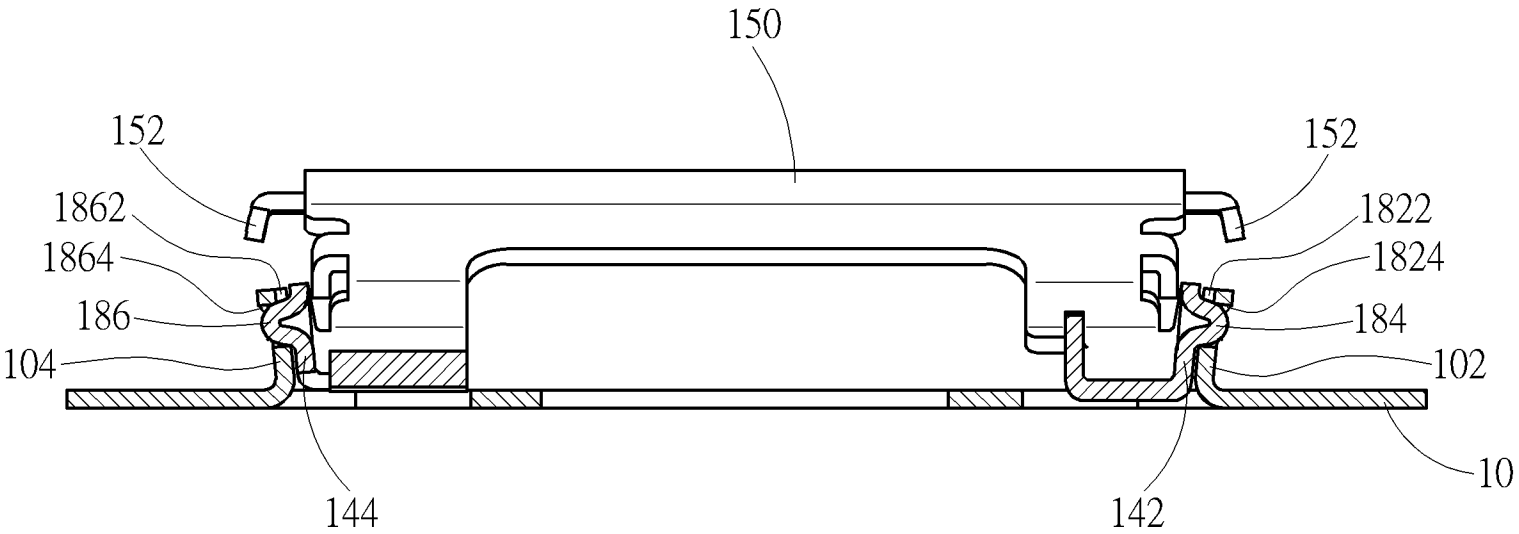
FIG. 7 is a sectional view of the first pivotal connection structure in FIG. 5 according to another embodiment.

Furthermore, in the embodiment, the first protruding shaft 184 and the third protruding shaft 188 is located between the first guiding slot 182 and the third guiding slot 186 along the first rotation axis A1. The first protruding shaft 184 and the third protruding shaft 188 protrude laterally outward from the cantilever plates 142 and 144 at the two sides of the first support 14. The first support 14 together with the first protruding shaft 184 and the third protruding shaft 188 show a U-shaped structure in a sectional plane passing through the first rotation axis A1 (as shown by FIG. 5), which is conducive to the above elastically fitting and elastically contacting. For example, the width of the bottom of the U-shaped structure is designed to be slightly smaller than the interval of the plate portions 102 and 104 (or the interval of the first guiding slot 182 and the third guiding slot 186), which is conducive to the above fitting operation. Furthermore, in practice, it is practicable that before the first protruding shaft 184 and the third protruding shaft 188 fit in the first indentation portion 1824 and the third indentation portion 1864, the cantilever plates 142 and 144 obliquely extend toward the first guiding slot 182 and the third guiding slot 186 (i.e. extending obliquely outward, as shown by FIG. 6), so as to be a U-shaped structure with a gradually opening (similar to a trapezoidal structure with upper bottom greater than lower bottom). This structural design can enhance the contact force of the above elastically contacting. From another aspect, the structural design allows a larger tolerance range, which helps the first support 14 to be assembled to the base plate 10. In addition, in practice, the first pivotal connection structure 18 also can be a U-shaped structure with a gradually opening, as shown by FIG. 7. In addition, after the first protruding shaft 184 and the third protruding shaft 188 fit in the first indentation portion 1824 and the third indentation portion 1864, the first indentation portion 1824 and the third indentation portion 1864 perform structural constraint to the first protruding shaft 184 and the third protruding shaft 188 in principle. Therefore, in practice, the first protruding shaft 184 and the third protruding shaft 188 are not limited to elastically contacting the first indentation portion 1824 and the third indentation portion 1864.

Figure 8:
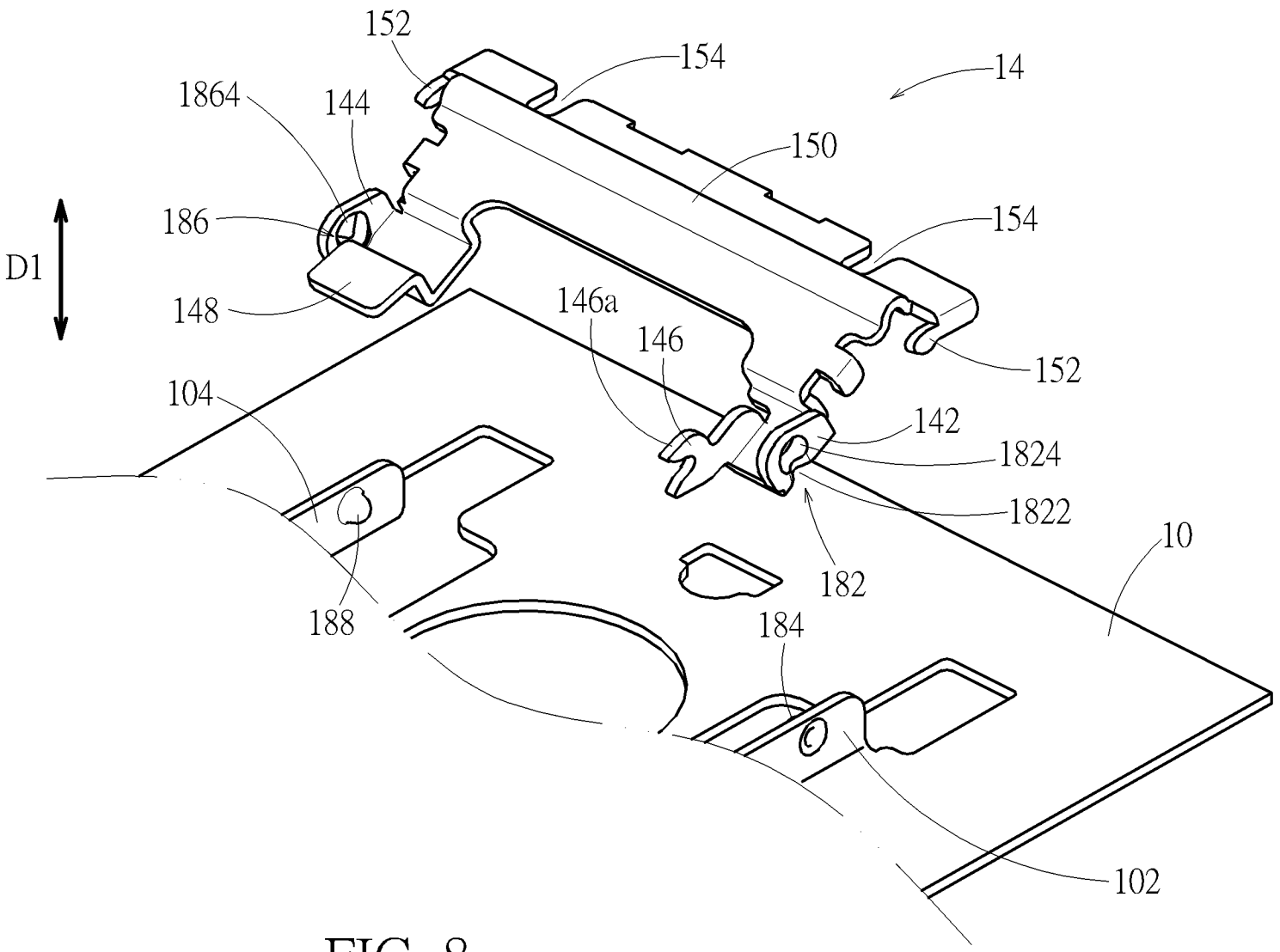
FIG. 8 is a sectional view of the first pivotal connection structure in FIG. 4 according to another embodiment.
Figure 9:
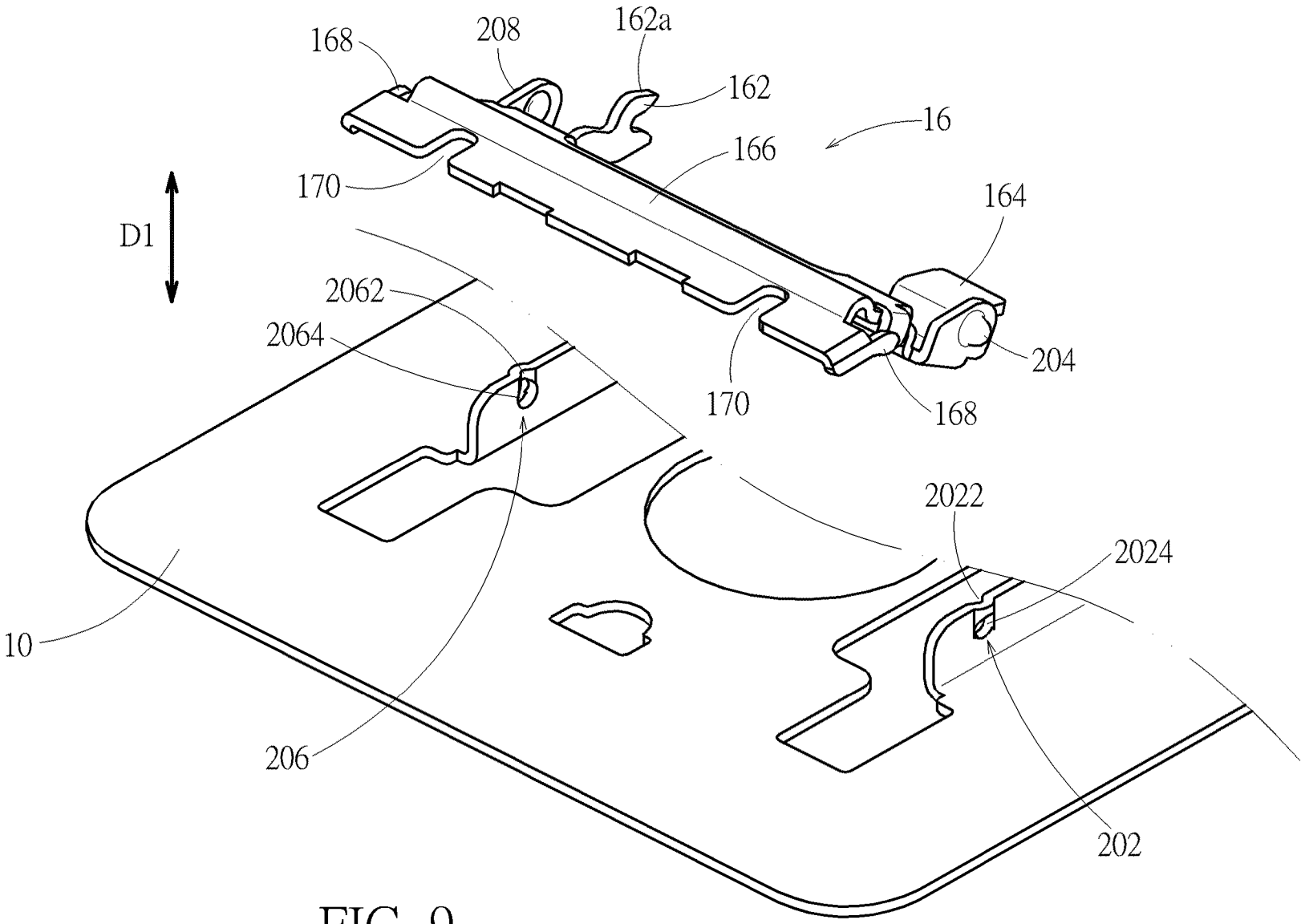
FIG. 9 is an exploded view of a second pivotal connection structure in FIG. 2.

Furthermore, in the embodiment, the first guiding slot 182 and the third guiding slot 186 are disposed on the base plate 10. The first protruding shaft 184 and the third protruding shaft 188 are disposed on the first support 10; however, it is not limited thereto in practice. For example, as shown by FIG. 8, the first guiding slot 182 and the third guiding slot 186 are modified to be disposed on the first support 10, and the first protruding shaft 184 and the third protruding shaft 188 are modified to be disposed on the base plate 10 correspondingly. Therein, the first guiding slot 182 and the third guiding slot 186 are located between the first protruding shaft 184 and the third protruding shaft 188 along the first rotation axis A1. Furthermore, in practice, the first protruding shaft 184 and the third protruding shaft 188 can be formed by plastic parts and integrated with the base plate 10 by insert molding. This structural configuration also can perform the above-mentioned engagement of the first protruding shaft 184 and the third protruding shaft 188 with the first guiding slot 182 and the third guiding slot 186, which will not be described in addition.

Please refer to FIG. 1 to FIG. 3 and FIG. 9. The second pivotal connection structure 18 includes a second guiding slot 202, a second protruding shaft 204, a fourth guiding slot 206, and a fourth protruding shaft 208. The second guiding slot 202 extends perpendicular to the second rotation axis A2 and has a second opening 2022 and a second indentation portion 2024. The second indentation portion 2024 is recessed parallel to the second rotation axis A2. The second protruding shaft 204 rotatably fits in the second indentation portion 2024 relative to the second rotation axis A2. The fourth guiding slot 206 extends perpendicular to the second rotation axis A2 and has a fourth opening 2062 and a fourth indentation portion 2064. The fourth indentation portion 2064 is recessed parallel to the second rotation axis A2. The fourth protruding shaft 208 rotatably fits in the fourth indentation portion 2064 relative to the second rotation axis A2. In the embodiment, the second guiding slot 202 and the fourth guiding slot 206 are disposed on the base plate 10. The second protruding shaft 204 and the fourth protruding shaft 208 are disposed on the second support 16 correspondingly. Thereby, the second support 16 is pivotally connected to the base plate 10 through the second pivotal connection structure 20, and therefore can rotate relative to the base plate 10 around the second rotation axis A2.

In the embodiment, the second guiding slot 202 and the fourth guiding slot 206 are structurally the same as the first guiding slot 182 and the third guiding slot 186. For other descriptions about the second guiding slot 202 and the fourth guiding slot 206, please refer to the relevant descriptions of the first guiding slot 182 and the third guiding slot 186 and variants thereof, which will not be described in addition. Furthermore, in the embodiment, the first guiding slot 182 and the second guiding slot 202 are structurally the same and are formed by the same plate portion 102 extending upward from the base plate 10. The third guiding slot 186 and the fourth guiding slot 206 are also structurally the same and are formed by the other same plate portion 104 extending upward from the base plate 10. However, it is not limited thereto in practice. For example, the first guiding slot 182 is disposed on the first support 10 (as shown by FIG. 8). The second guiding slot 202 is disposed on the base plate 10. Therein, the first protruding shaft 184 (disposed on the base plate 10) and the second guiding slot 202 still can be formed by the same plate portion 102 extending upward from the base plate 10.

Please refer to FIG. 2 to FIG. 4 and FIG. 9 to FIG. 11. The first support 14 includes a first engaging portion 146 and a first engaging tab 148 disposed apart along the first rotation axis A1. The second support 16 includes a second engaging portion 162 and a second engaging tab 164 disposed apart along the second rotation axis A2. The first engaging portion 146 and the second engaging tab 164 are disposed oppositely. The first engaging tab 148 and the second engaging portion 162 are disposed oppositely. The first engaging tab 148 fits in the second engaging portion 162, and the second engaging tab 164 fits in the first engaging portion 146, so that the first support 14 and the second support 16 can drive each other to rotate. In the embodiment, the first engaging portion 146 and the second engaging portion 162 respectively are a plate structure that has a narrow slot and extends perpendicular to the first engaging tab 148 and the second engaging tab 164 (i.e. perpendicular to the first rotation axis A1 and the second rotation axis A2. After the first engaging tab 148 fits and the second engaging tab 164 fit in the narrow slots, the first support 14 and the second support 16 can drive each other to rotate. However, the invention is not limited thereto in practice. For example, the first engaging portion 146 can be realized by several plate structures that bend upward or downward relative to the first rotation A1. These curved plate structures are staggered along the first rotation A1, so as to engage with the second engaging tab 164 (i.e. in the view point of the first rotation axis A1, the second engaging tab 164 is held between the plate structures bending upward or downward. The above is also applicable to the second engaging portion 162, which will not be described in addition.

Figure 11:
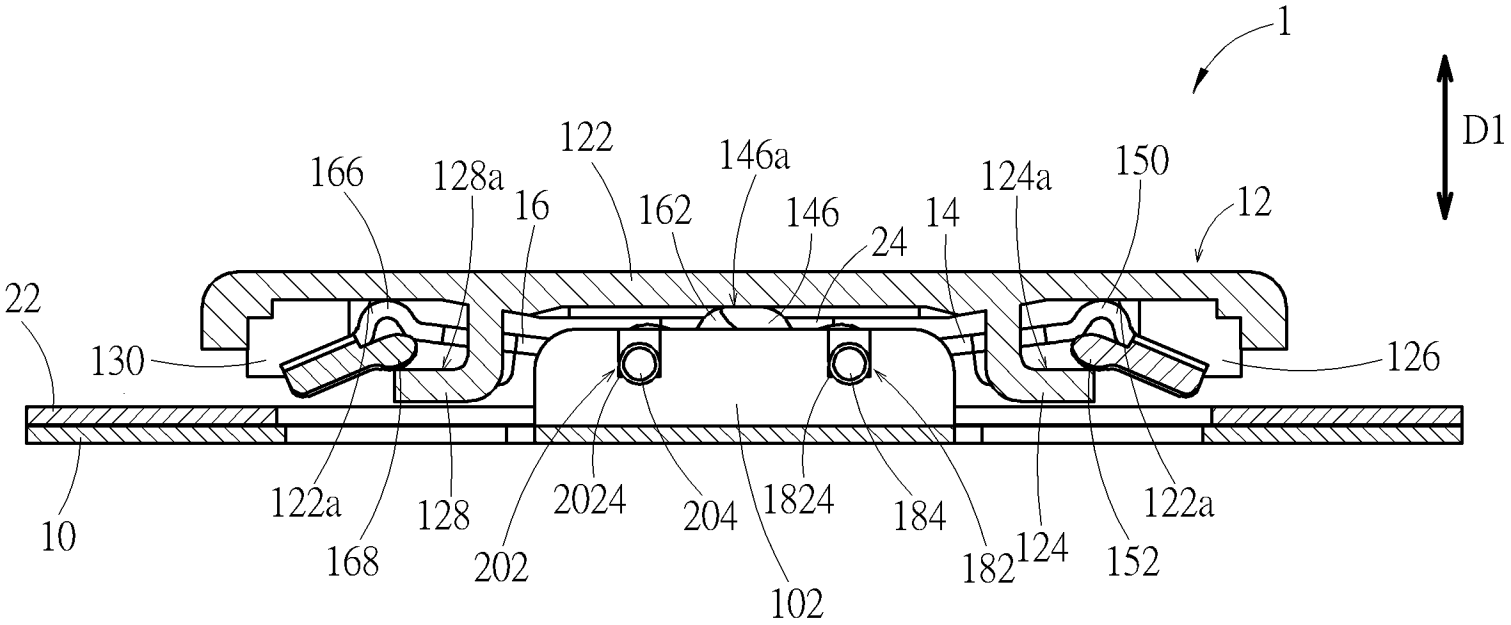
FIG. 11 is a sectional view of the keyswitch structure in FIG. 10 when a keycap thereof is pressed; therein, a resilient restoration part is not shown.

Furthermore, in the embodiment, the first engaging portion 146 has a first limitation portion 146*a* (e.g. an upper edge of the first engaging portion 146). The second engaging portion 162 has a second limitation portion 162*a* (e.g. an upper edge of the second engaging portion 162). When the keycap 12 is located at a pressed position (as shown by FIG. 11), the first limitation portion 146*a* and the second limitation portion 162*a* abuts against the keycap body 122. In practice, the structures of the first limitation portion 146*a* and the second limitation portion 162*a* can be designed for increasing the stability of the first limitation portion 146*a* and the second limitation portion 162*a* blocking the keycap 12. For example, the upper edges of the first engaging portion 146 and the second limitation portion 162*a* remain horizontal when the keycap 12 is located at the pressed position, which can increase the area of the first engaging portion 146 and the second limitation portion 162*a* contacting the keycap body 122.

Figure 10:
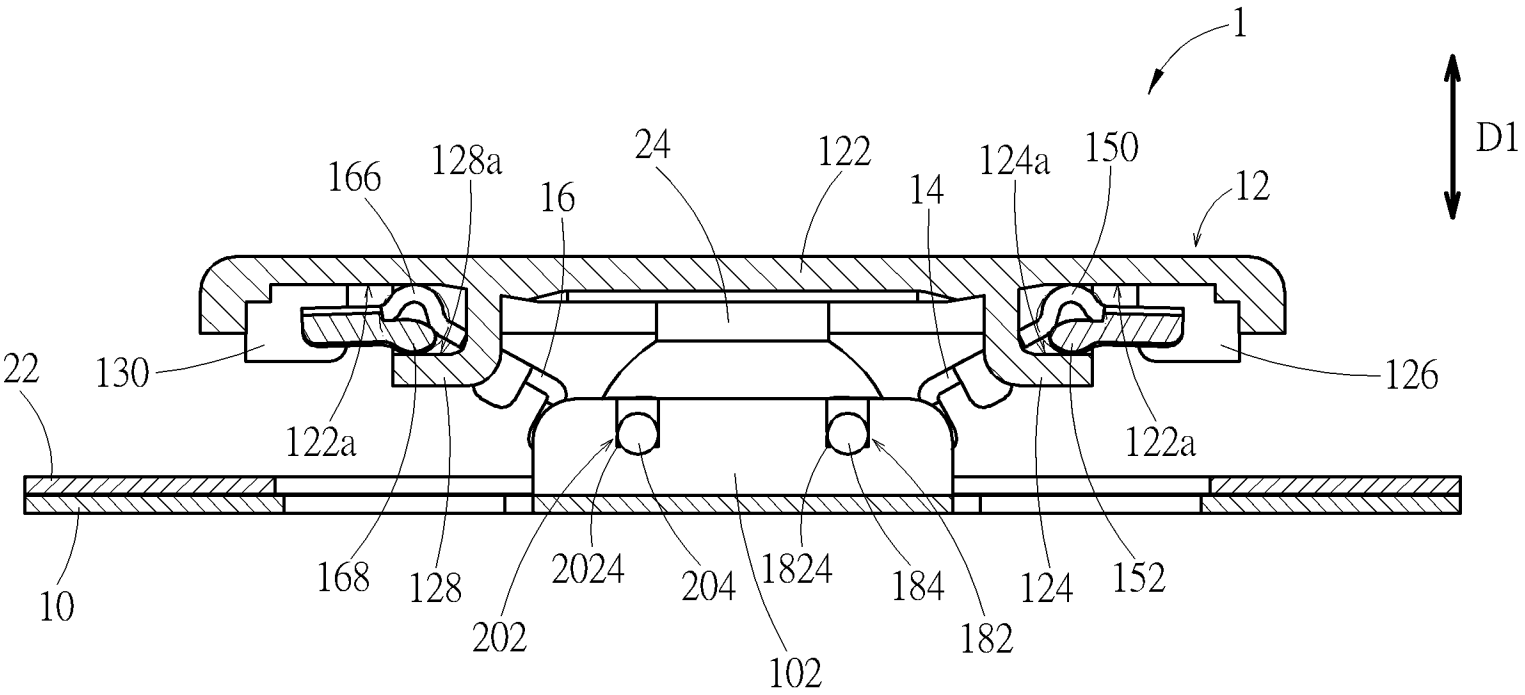
FIG. 10 is a sectional view of the keyswitch structure in FIG. 1 along the line X-X.

Please refer to FIG. 2, FIG. 4, FIG. 10 and FIG. 11. The keycap 12 includes a keycap body 122 and two first sliding slot 124 disposed on the keycap body 122. The keycap body 122 has a bottom surface 122*a* toward the base plate 10. The first sliding slot 124 has a sliding surface 124*a* opposite to the bottom surface 122*a*. The first support 14 includes a first keycap abutting portion 150 and two first sliding portions 152. The first sliding portion 152 is located at two sides of the first keycap abutting portion 150. The first keycap abutting portion 150 abuts against the bottom surface 122*a*. The first sliding portion 152 slides against the sliding surface 124*a* of the first sliding slot 124 correspondingly. Thereby, the first support 14 can slide and rotate relative to the keycap 12. In the view point of the first rotation axis A1, the first rotation axis A1 (or the first protruding shaft 184) is located between the first keycap abutting portion 150 (or the first sliding portion 152) and the first engaging portion 146 (or the first engaging tab 148). Furthermore, in the embodiment, the first keycap abutting portion 150 is a semi-cylindrical surface and slides against the bottom surface 122*a* through the semi-cylindrical surface. The sliding portion 152 is a cantilever structure extending perpendicular to the first rotation axis A1. A free end of the cantilever structure has a semi-circular raised surface and slides against the sliding surface 124*a* through the semi-circular raised surface. As shown by FIG. 10 and FIG. 11, from the view point of the first rotation axis A1, the semi-cylindrical surface of the first keycap abutting portion 150 and the semi-circular raised surface can substantially forma circle (indicated by a circle of chain line in FIG. 10), so the first keycap abutting portion 150 and the first sliding portion 152 can make the first support 14 stably rotate relative to the keycap 12. Furthermore, the sliding portion 152 provided in a cantilever structure also is elastic, which helps the first keycap abutting portion 150 and the first sliding portion 152 keep abutting against the bottom surface 122*a* and the sliding surface 124*a* when the keycap 12 moves relative to the base plate 10.

Figure 12:
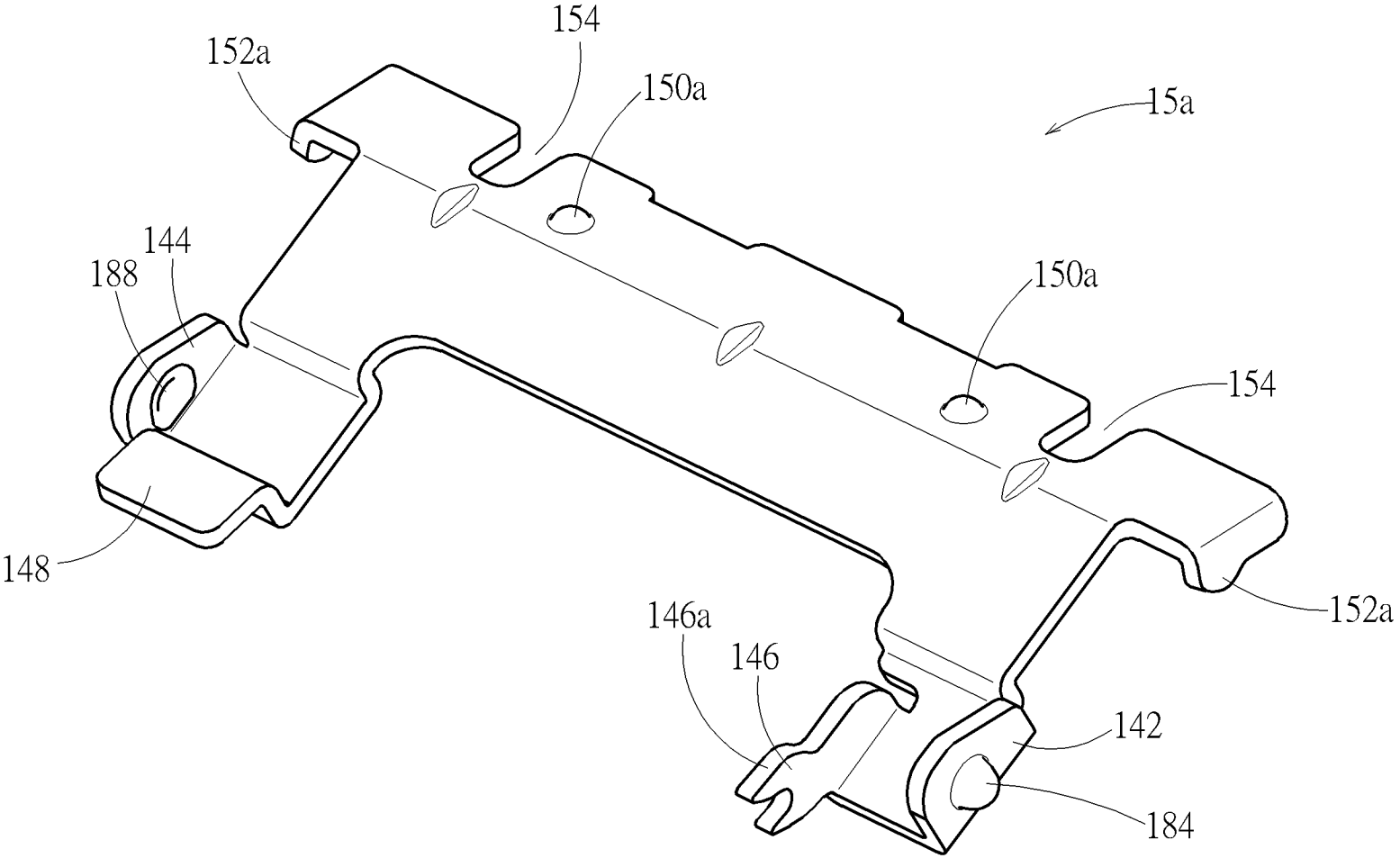
FIG. 12 is a schematic diagram illustrating a first support according to another embodiment.
Figure 13:
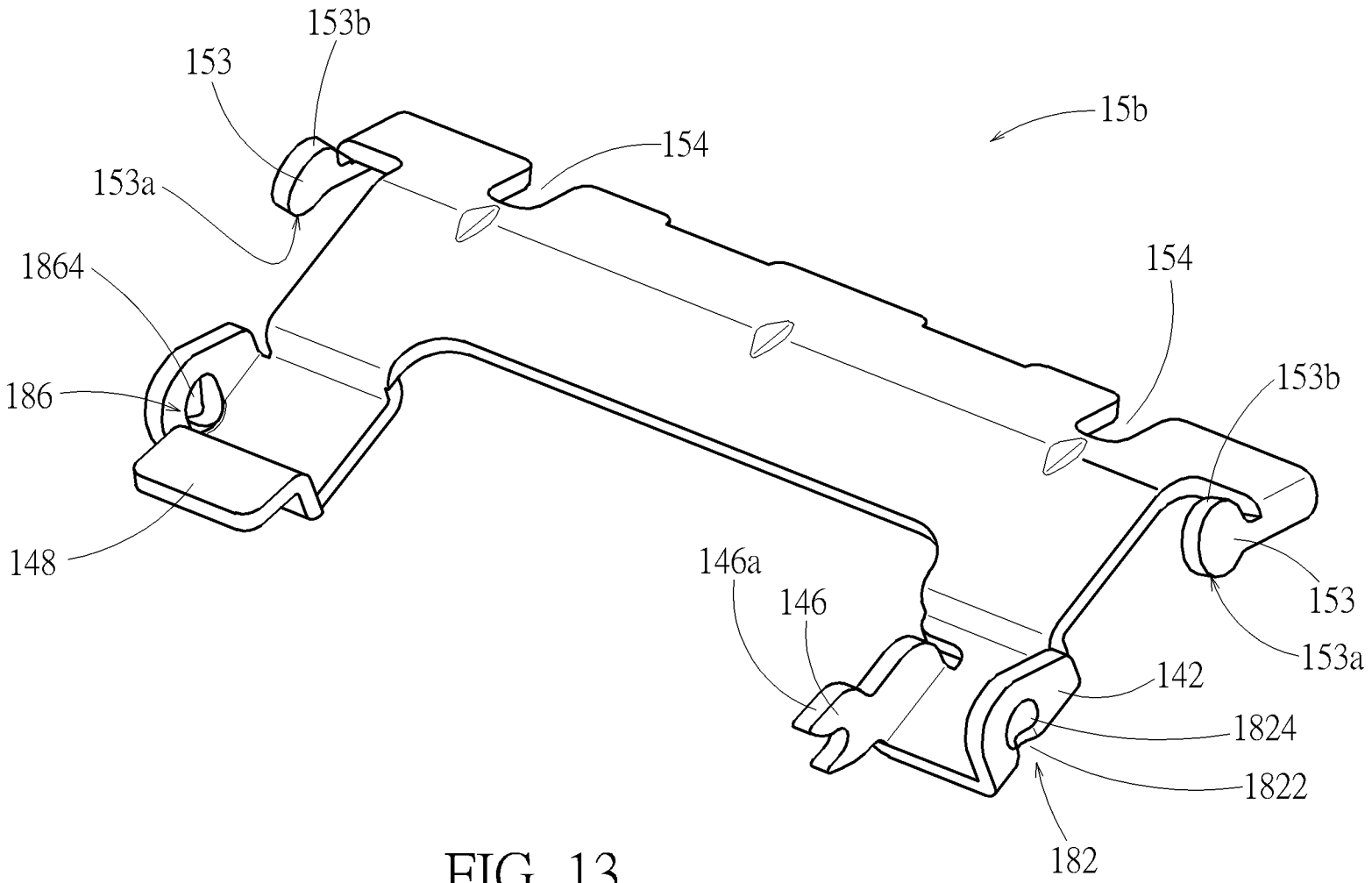
FIG. 13 is a schematic diagram illustrating a first support according to another embodiment.
Figure 14:
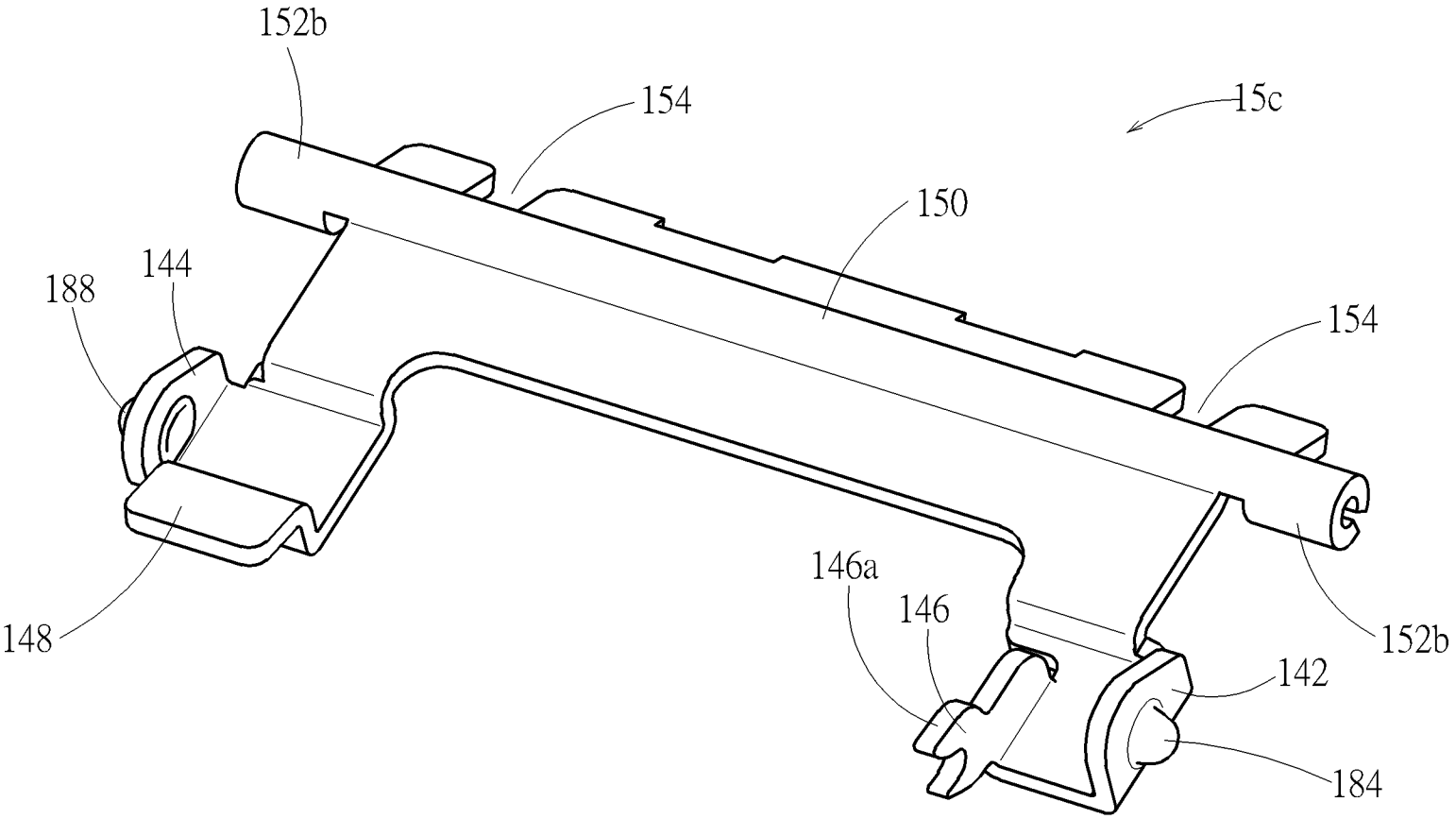
FIG. 14 is a schematic diagram illustrating a first support according to another embodiment.
Figure 15:
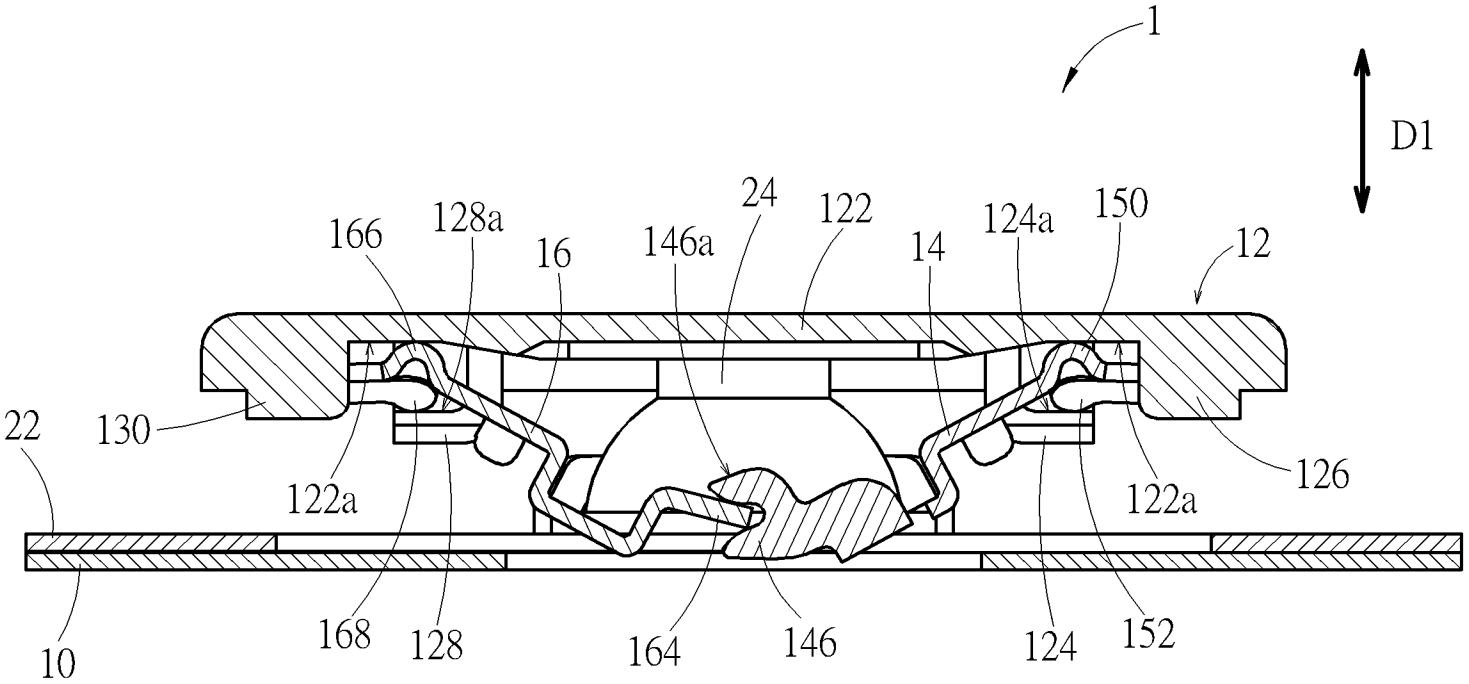
FIG. 15 is a sectional view of the keyswitch structure in FIG. 1 along the line Y-Y.
Figure 16:
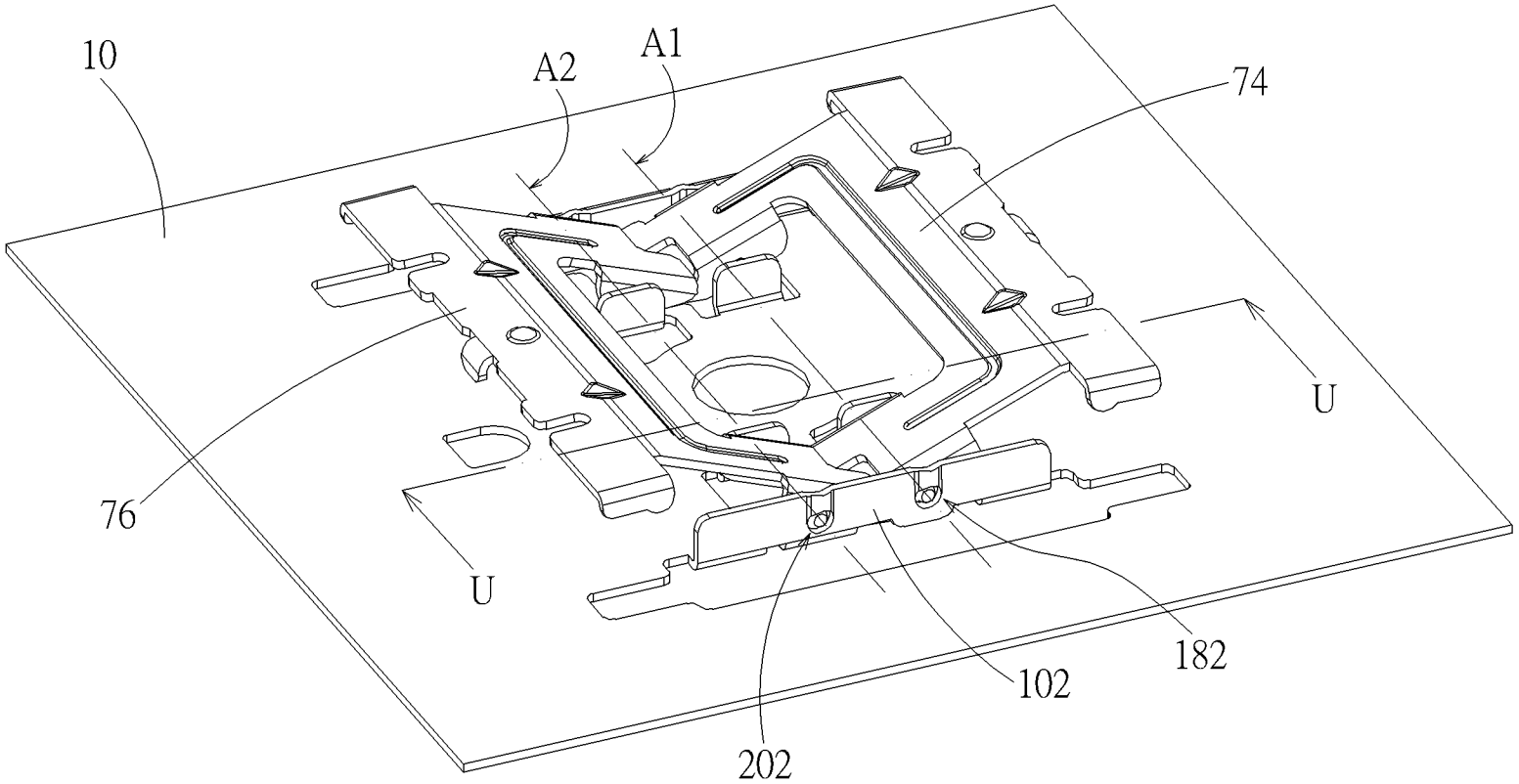
FIG. 16 is a schematic diagram illustrating part of a keyswitch structure according to an embodiment.
Figure 17:
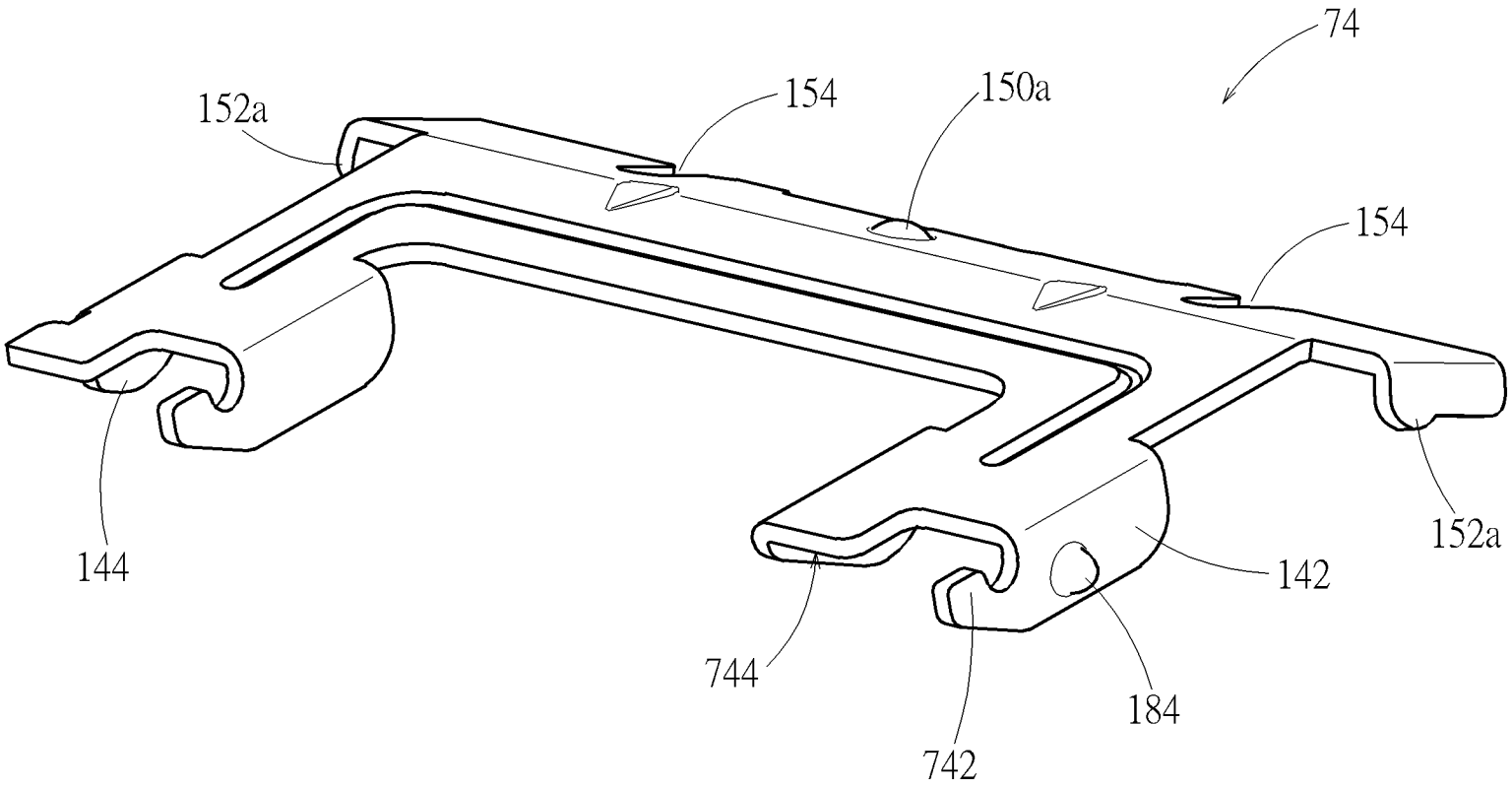
FIG. 17 is a schematic diagram illustrating a first support in FIG. 16.
Figure 18:
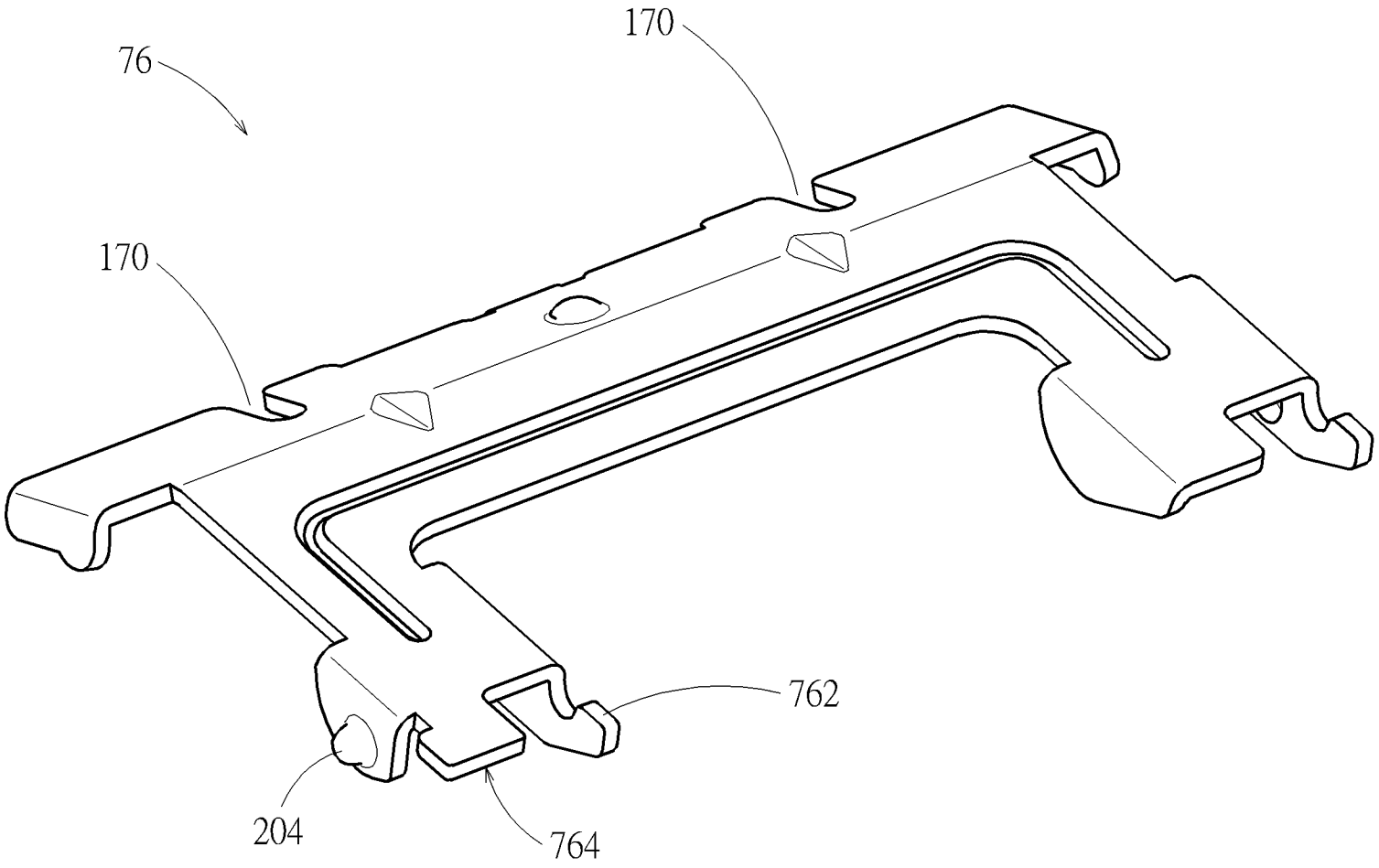
FIG. 18 is a schematic diagram illustrating a second support in FIG. 16.

Furthermore, in practice, the first keycap abutting portion 150 and the first sliding portion 152 can be realized by other structures. For example, a first support 15*a* shown by FIG. 12 uses two upward protruding portions 150*a* as the first keycap abutting portion 150 and uses two downward bent portions 152*a* as the first sliding portion 152. Thereby, the first support 15*a* is connected to the keycap 12 through the protruding portions 150*a* and the bent portions 152*a*. Therein, the protruding portion 150*a* also can be formed by bending a portion support body of the first support 15*a* in practice. Furthermore, in practice, the first keycap abutting portion 150 and the two first sliding portions 152 can be structurally integrated. For example, a first support 15*b* shown by FIG. 13 includes two cantilever structures 153 located at two opposite sides of the first support 15*b*. The two cantilever structures 153 are slidably and rotatably disposed on the first sliding slot 124 (which can refer to FIG. 2). The free end of the cantilever structure 153 shows a circular plate. A lower surface 153*a* thereof functions as the first sliding portion 152. An upper surface 153*b* thereof functions as the first keycap abutting portion 150. For another example, a first support 15*c* shown by FIG. 14 includes two posts 152*b* extending outward from the first keycap abutting portion 150 (e.g. which are formed by rolling up a portion of the first support 15*c*) and slidably and rotatably disposed on the first sliding slot 124 (which can refer to FIG. 2) for functioning as the first sliding portion 152. In addition, in the embodiment, the first support 14 shows a downward opening at the two first sliding portions 152. A gradually n-shaped structure (which can refer to FIG. 5) is also conducive to the assembly of the first support 14 and the keycap 12, which will not be described in addition.

Please refer to FIG. 2, FIG. 4, FIG. 10, FIG. 11 and FIG. 15. In the embodiment, the keycap 12 includes two first limitation blocks 126 disposed on the keycap body 122. The first support 14 has two first horizontal limitation slots 154 corresponding to the two first limitation blocks 126. The first limitation block 126*s* are relatively slidably inserted into the first horizontal limitation slot 154, so when the first support 14 horizontally moves relative the keycap 12, the first limitation block 126 relatively moves in the first horizontal limitation slot 154. In practice, the length of the first horizontal limitation slot 154 can be designed for (the closed end of) the first horizontal limitation slot 154 to block the first limitation block 126 for controlling the pressed position of the keycap 12.

Please refer to FIG. 2, FIG. 9 to FIG. 11 and FIG. 15. In the embodiment, the keycap 12 includes two second sliding slots 128 and two second limitation blocks 130 disposed on the keycap body 122. The second sliding slot 128 has a sliding surface 128*a* opposite to the bottom surface 122*a*. The second support 16 includes a second keycap abutting portion 166, two second sliding portions 168, and two second horizontal limitation slots 170. The second sliding portions 168 are located at two sides of the second keycap abutting portion 166. The second keycap abutting portion 166 abuts against the bottom surface 122*a*. The second sliding portion 168 slides against the sliding surface 128*a* of the second sliding slot 128 correspondingly. Thereby, the second support 16 can slide and rotate relative to the keycap 12. The second limitation block 130 is relatively slidably inserted into the second horizontal limitation slot 170, so that when the second support 16 horizontally moves relative to the keycap 12, the second limitation block 130 relatively slides in the second horizontal limitation slot 170. For other descriptions about the connection structure of the second support 16 and the keycap 12 and variants thereof, please refer to the relevant descriptions of the structures in the same name of the first support 14 and variants thereof, which will not be described in addition.

In addition, in the embodiment, the first support 14 shows an n-shaped structure. The first engaging portion 146 and the first engaging tab 148 are located at two ends of the n-shaped structure. The second support 16 also shows an n-shaped structure. The second engaging portion 162 and the second engaging tab 164 are located at two ends of the n-shaped structure. The first support 14 and the second support 16 are connected to form a looped structure. The resilient restoration part 20 passes through the looped structure. The first support 14 and the second support 16 are the same structure, which is conducive to a reduction of the production cost. However, it is not limited thereto in practice. For example, the two ends of the first support 14 respectively are first engaging portion 146; correspondingly, the two ends of the second support 16 respectively are the second engaging tab 164. Furthermore, in practice, the connection of the first support 14 and the second support 16 also can be achieved by only the engagement of the first engaging portion 146 and the second engaging tab 164 or the engagement of the second engaging tab 148 and the second engaging portion 162.

Figure 19:
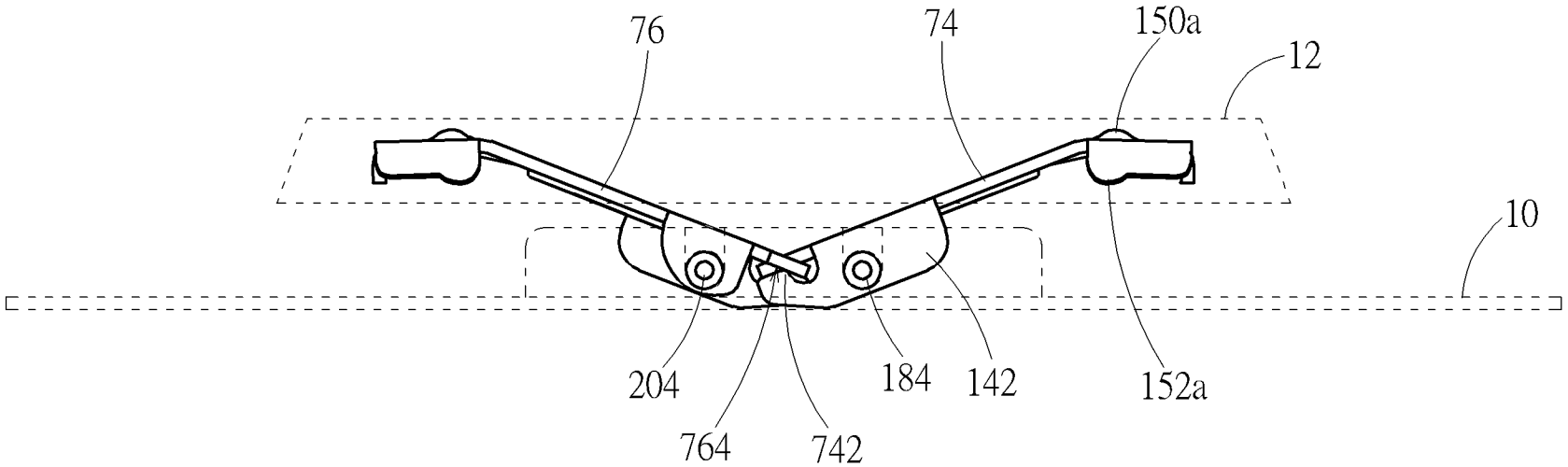
FIG. 19 is a side view of the first support and the second support in FIG. 16.
Figure 20:
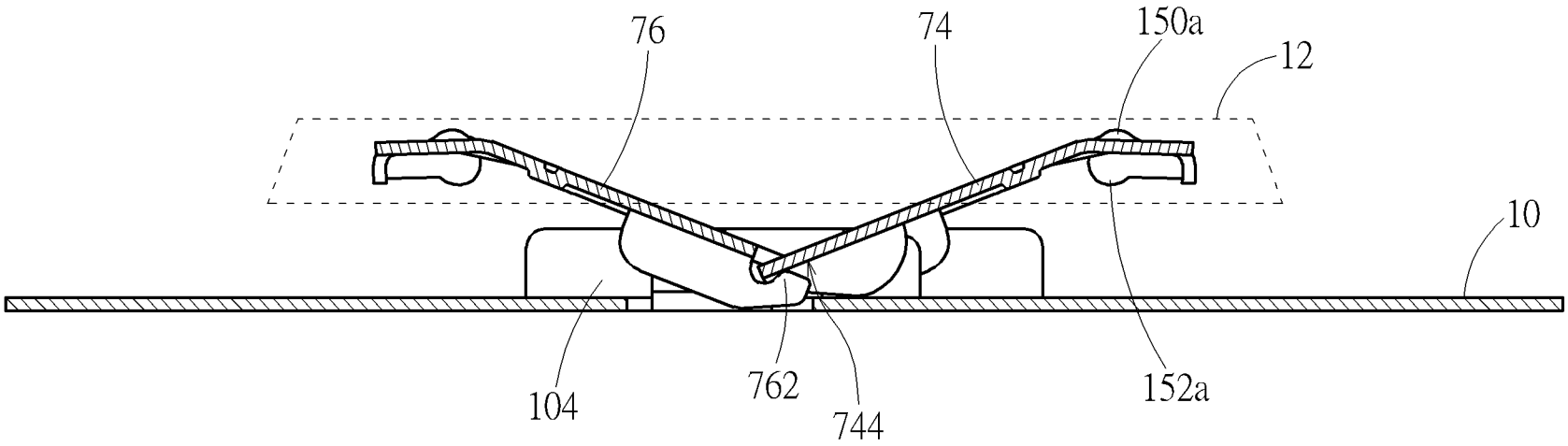
FIG. 20 is a sectional view along the line U-U in FIG. 16.
Figure 21:
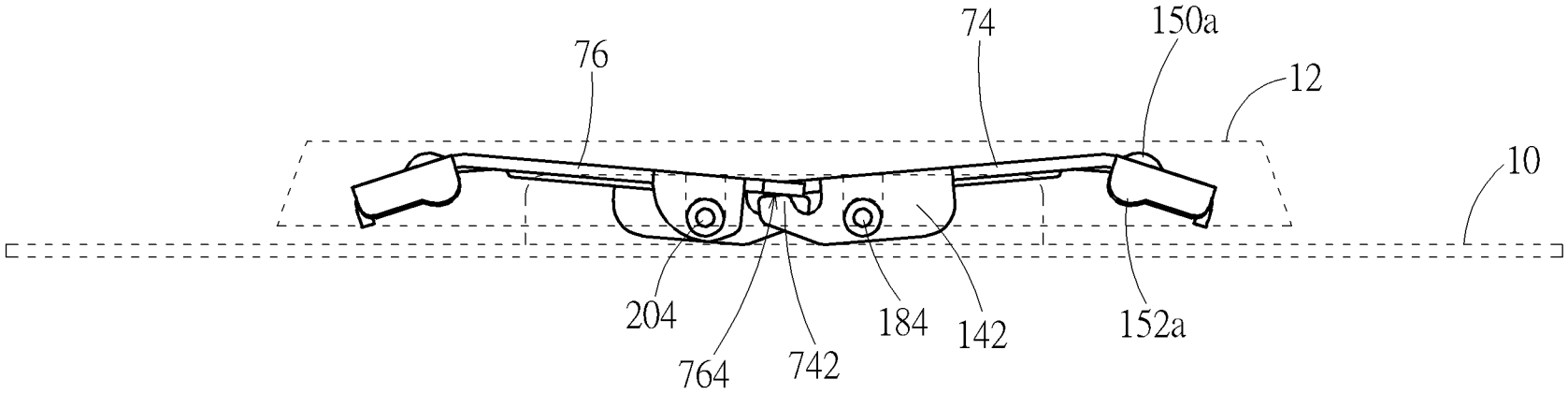
FIG. 21 is a sectional view of the keyswitch structure in FIG. 16 when a keycap thereof is pressed.

Furthermore, in the embodiment, the first support 14 and the second support 16 are connected through the engaging tabs 148 and 164 and the engaging portions 146 and 162; however, it is not limited thereto in practice. Please refer to FIG. 16 to FIG. 21, which show part of a keyswitch structure according to another embodiment. The keyswitch structure is structurally similar to the keyswitch structure 1. For simplification of description, the reference numbers of the keyswitch structure 1 and variants thereof are continuously used herein in principle. For other descriptions about the keyswitch structure of this embodiment, please refer to relevant descriptions of the keyswitch structure 1 and variants thereof, which will not be described in addition. In the embodiment, the first support 74 and the second support 76 are connected to and between the keycap 12 (of which the profile is shown in dashed lines in FIG. 19 to FIG. 21) and the base plate 10, so that the keycap 12 can vertically move up and down relative to the base plate 10 through the first support 74 and the second support 76. The first support 74 and the second support 76 are engaged with each other so as to be able to drive each other to rotate. Therein, the first support 74 includes a first pushing-against portion 742 and a first abutting surface 744. The second support 76 includes a second pushing-against portion 762 and a second abutting surface 764. The first pushing-against portion 742 continuously slides against the second abutting surface 764, and the second pushing-against portion 762 continuously slides against the first abutting surface 744, so that the first support 74 and the second support 76 can drive each other to rotate. That is, when the first support 74 and the second support 76 rotate relative to the base plate 10, the first pushing-against portion 742 can keep abutting against the second abutting surface 764 and the second pushing-against portion 762 can keep abutting against the first abutting surface 744. Thereby, when the keycap 12 moves up and down relative to the base plate 10, the first support 74 and the second support 76 keep abutting against each other to drive each other to rotate.

Furthermore, in the embodiment, the first pushing-against portion 742 is located under the second abutting surface 764. The second pushing-against portion 762 is located under the first abutting surface 744. The first abutting surface 744 and the second abutting surface 764 respectively are a flat surface. The flat surface faces the base plate 10. The first pushing-against portion 742 and the second pushing-against portion 762 respectively are a curved surface. However, it is not limited thereto in practice. For example, the first pushing-against portion 742 and the second pushing-against portion 762 can be a sharp edge (e.g. plate edge). For example, the first abutting surface 744 and the second abutting surface 764 can be a curved surface. Furthermore, in the embodiment, the first pushing-against portion 742 is in line contact with the second abutting surface 764. The second pushing-against portion 762 is in line contact with the first abutting surface 744. Furthermore, in the embodiment, the first abutting surface 744 and the second abutting surface 764 are the same structure. The first pushing-against portion 742 and the second pushing-against portion 762 are the same structure. However, it is not limited thereto in practice. In addition, in the embodiment, the first support 74 and the second support 76 respectively are substantially an n-shaped structure. The first support 74 and the second support 76 are engaged with each other at two sides (i.e. at two ends of each n-shaped structure). The foregoing is based on the engagement structure at one side. The engagement structure at the other side is the same and will not be described in addition. However, in practice, the engagement structures at the two sides are unnecessary to be the same. Furthermore, in practice, the first support 74 and the second support 76 also can be engaged at single side, which also can perform the effect of driving each other to rotate. In addition, in the embodiment, the first support 74 and the second support 76 respectively are a metal pressing part. However, it is not limited thereto in practice. For example, the first support 74 and the second support 76 can be formed by plastic injection instead.

Please refer to FIG. 22 to FIG. 25. A keyswitch structure 3 according to another embodiment includes a base plate 30, a keycap 32, a first support 34, a second support 36, a switch circuit board 38, and a resilient restoration part 40. The keycap 32 is disposed above the base plate 30. The first support 34 and the second support 36 are staggered between the keycap 12 and the base plate 10. The switch circuit board 38 is disposed under the base plate 30 and includes a switch 382 (shown by a circle with hatched lines in FIG. 24). The resilient restoration part 40 is disposed above the switch circuit board 38 corresponding to the switch 382. Thereby, the keycap 32 can move up and down relative to the base plate 30 through the first support 34 and the second support 36. When moving downward, the keycap 32 can compress the resilient restoration part 40 to trigger the switch 382. In practice, the switch circuit board 38 can be but not limited to a conventional membrane circuit board, and the structural details thereof will not be described in addition. For simplification of drawing, the switch circuit board 38 still is shown by a single solid part. The resilient restoration part 40 can be but not limited to a silicon or rubber dome.

In the embodiment, the base plate 30 includes a plate body 300 and a first hook 302, a second hook 304, a third hook 306, a fourth hook 308, a first limitation post 310 and a second limitation post 312 which are disposed on the plate body 300. In practice, the first hook 302, the second hook 304, the third hook 306, the fourth hook 308, the first limitation post 310, and the second limitation post 312 can be structurally integrated into a plastic part and combine with the plate body 300. For example, but not limited thereto, the plate body 300 is a metal pressing part. The plastic part is joined with the plate body 300 by injection molding. The keycap 32 is disposed above the base plate 30 and includes a keycap body 320 and two first vertical limitation slots 322, two second vertical limitation slots 324, two first limitation blocks 326, and two second limitation blocks 328 which are disposed on the keycap body 320. The keycap body 320 has a bottom surface 320*a* toward the base plate 10. The first vertical limitation slot 322 and the second vertical limitation slot 324 have limitation surfaces 322*a* and 324*a* toward the bottom surface 320*a* respectively.

Figure 25:
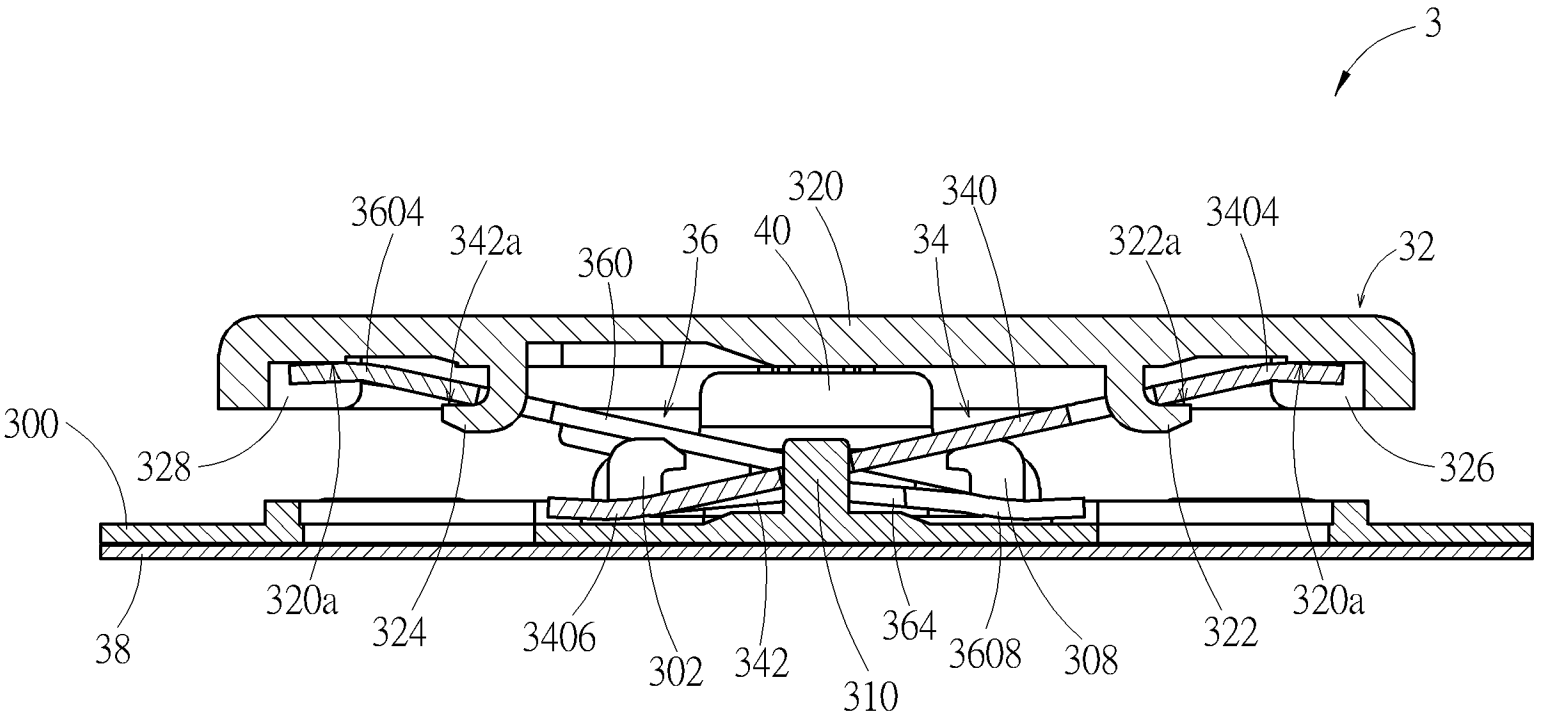
FIG. 25 is a sectional view of the keyswitch structure in FIG. 22 along the line Z-Z.

The first support 34 includes a first support body 340 and a first abutting arm 342 and a third abutting arm 344 that extend from the first support body 340. The first support 34 is connected to and between the keycap 32 and the base plate 30 through the first support body 340. Therein, the first support body 340 has a first keycap abutting portion 3402, two first limitation portions 3404, a first base plate abutting portion 3406, a third base plate abutting portion 3408, a first limitation hole 3410, and two first horizontal limitation slots 3412. The first keycap abutting portion 3402 abuts against the bottom surface 320*a*. The two first limitation portions 3404 are disposed in the two first vertical limitation slots 322 respectively. When the keycap 32 is not pressed (as shown by FIG. 25), the first limitation portion 3404 abuts against the limitation surface 322*a*.

The first base plate abutting portion 3406 and the third base plate abutting portion 3408 abuts against the base plate 30, so that the first support body 340 can rotate relative to the base plate 30 through the first base plate abutting portion 3406 and the third base plate abutting portion 3408. The first hook 302 and the third hook 306 hook the first base plate abutting portion 3406 and the third base plate abutting portion 3408 respectively. The first limitation post 310 extends into the first limitation hole 3410. By the structural constraint therebetween, the rotation stability of the first support body 340 relative to the base plate 30 can be enhanced. The two first limitation blocks 326 are relatively slidably inserted in the two first horizontal limitation slots 3412 respectively, so that when the first support 34 horizontally moves relative to the keycap 32, the first limitation block 326 relatively slides in the first horizontal limitation slot 3412. In practice, the length of the first horizontal limitation slot 3412 can be designed for (the closed end of) the first horizontal limitation slot 3412 to block the first limitation block 326 for controlling the pressed position of the keycap 32. Furthermore, the first support body 340 shows a first n-shaped structure. The first base plate abutting portion 3406 and the third base plate abutting portion 3408 are located at two end portions of the first n-shaped structure. The first keycap abutting portion 3402 and the first base plate abutting portion 3406 (and the third base plate abutting portion 3408) are located at two opposite sides of the first support body 340. The first abutting arm 342 extends from the first base plate abutting portion 3406. The third abutting arm 344 extends from the third base plate abutting portion 3408.

The second support 36 includes a second support body 360 and a second abutting arm 362 and a fourth abutting arm 364 that extend from the second support body 360. The second support 36 is connected to and between the keycap 32 and the base plate 30 through the second support body 360. Therein, the second support body 360 has a second keycap abutting portion 3602, two second limitation portions 3604, a second base plate abutting portion 3606, a fourth base plate abutting portion 3608, a second limitation hole 3610, and two second horizontal limitation slots 3612. The second keycap abutting portion 3602 abuts against the bottom surface 320*a*. The two second limitation portions 3604 are disposed corresponding to the two second vertical limitation slots 324. When the keycap 32 is not pressed (as shown by FIG. 25), the second limitation portion 3604 abuts against the limitation surface 324*a*. The second base plate abutting portion 3606 and the fourth base plate abutting portion 3608 abut against the base plate 30, so that the second support body 360 can rotate relative to the base plate 30 through the second base plate abutting portion 3606 and the fourth base plate abutting portion 3608. The second hook 304 and the fourth hook 308 hook the second base plate abutting portion 3606 and the fourth base plate abutting portion 3608 respectively. The second limitation post 312 extends into the second limitation hole 3610. By the structural constraint therebetween, the rotation stability of the second support body 360 relative to the base plate 30 can be enhanced. The two second limitation blocks 328 are relatively slidably inserted in the two second horizontal limitation slot 3612 respectively, so that when the second support 36 horizontally moves relative to the keycap 32, the second limitation block 328 relatively slides in the second horizontal limitation slot 3612. In practice, the length of the second horizontal limitation slot 3612 can be designed for (the closed end of) the second horizontal limitation slot 3512 to block the second limitation block 328 for controlling the pressed position of the keycap 32. Furthermore, the first support body 360 shows a first n-shaped structure. The second base plate abutting portion 3606 and the fourth base plate abutting portion 3608 are located at two end portions of the second n-shaped structure. The second keycap abutting portion 3602 and the second base plate abutting portion 3606 (and the fourth base plate abutting portion 3608) are located at two opposite sides of the second support body 360. The second abutting arm 362 extends from the second base plate abutting portion 3606. The fourth abutting arm 364 extends from the fourth base plate abutting portion 3608.

Figure 26:
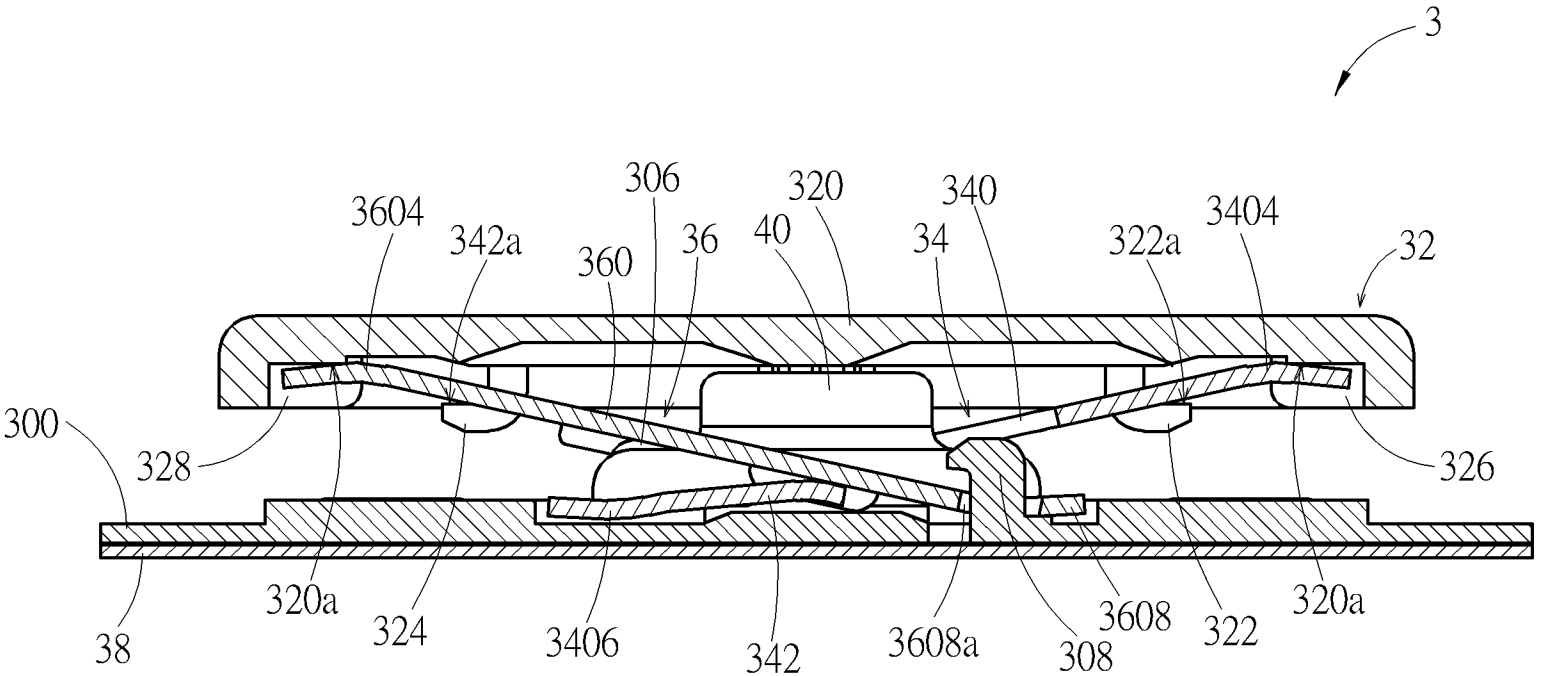
FIG. 26 is a sectional view of the keyswitch structure in FIG. 22 along the line W-W.
Figure 27:
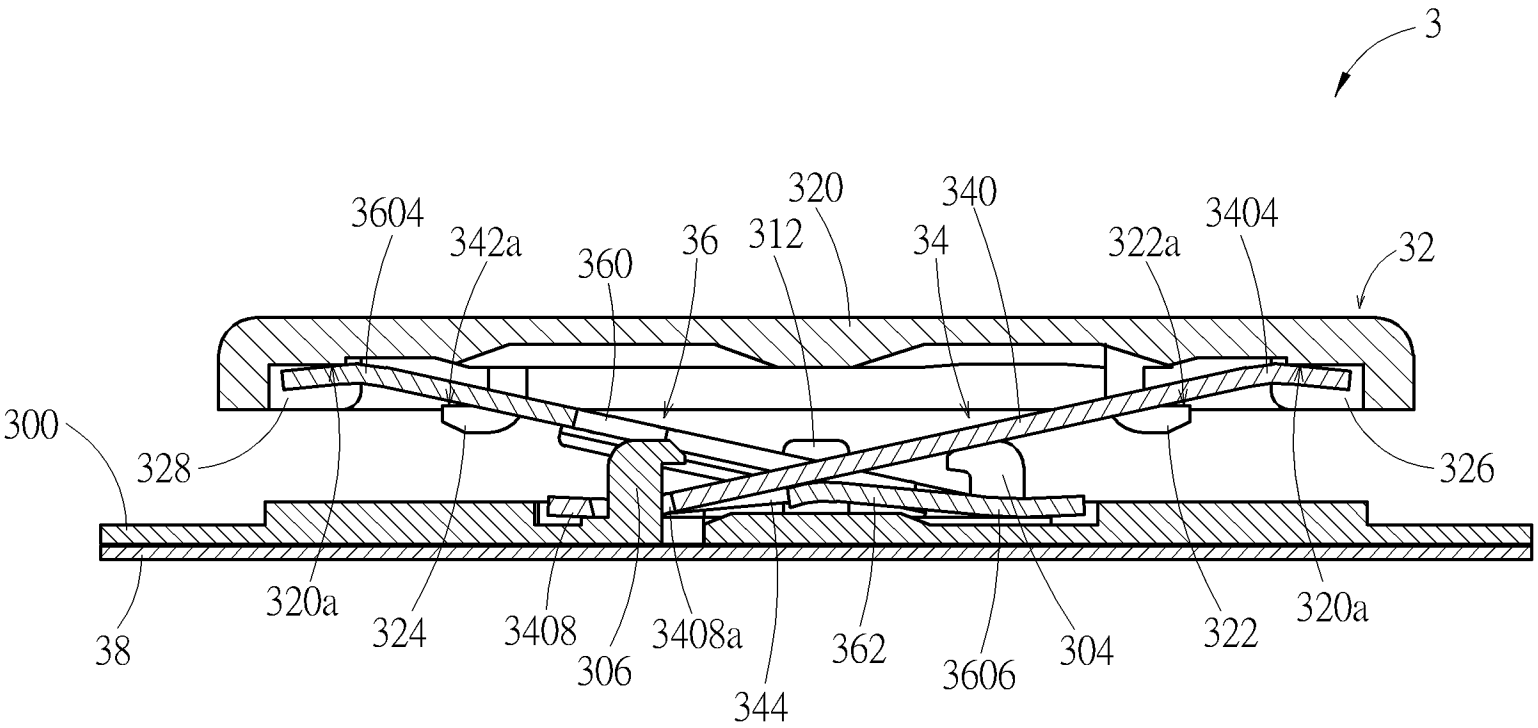
FIG. 27 is a sectional view of the keyswitch structure in FIG. 22 along the line V-V.

Furthermore, please also refer to FIG. 26 and FIG. 27. The first abutting arm 342 and the third abutting arm 344 are located between the second support body 360 and the base plate 30 and abut against the second support body 360. Therein, the portions of the first abutting arm 342 and the third abutting arm 344 that abut against the second support body 360 are located between the second keycap abutting portion 3602 and the second base plate abutting portion 3606 (and the fourth base plate abutting portion 3608). Thereby, when the second support body 360 rotates toward the base plate 30, the second support body 360 will press down the first abutting arm 342 and the third abutting arm 344, so that the first support body 340 is driven to rotate toward the base plate 30. Furthermore, when the first support body 340 rotates away relative to the base plate 30, the first abutting arm 342 and the third abutting arm 344 will lift the second support body 360, so that the second support body 360 is driven to rotate away relative to the base plate 30. Furthermore, the second abutting arm 362 and the fourth abutting arm 364 are located between the first support body 340 and the base plate 30 and abut against the first support body 340. Therein, the portions of the second abutting arm 362 and the fourth abutting arm 364 that abut against the first support body 340 are located between the first keycap abutting portion 3402 and the first base plate abutting portion 3406 (and the third base plate abutting portion 3408). Thereby, when the first support body 340 rotates toward the base plate 30, the first support body 340 will press down the second abutting arm 362 and the fourth abutting arm 364, so that the second support body 360 is driven to rotate toward the base plate 30. Furthermore, when the second support body 360 rotates away relative to the base plate 30, the second abutting arm 362 and the fourth abutting arm 364 will lift the first support body 340, so that the first support body 340 is driven to rotate away relative to the base plate 30. From another aspect, the first support 34 and the second support 36 drive each other to rotate through the first abutting arm 342, the second abutting arm 362, the third abutting arm 344, and the fourth abutting arm 364.

Furthermore, in the embodiment, the first support 34 and the second support 36 respectively show an n-shaped structure. The first support 34 and the second support 36 are staggered and connected to form a looped structure. The resilient restoration part 40 passes through the looped structure. The first support 34 and the second support 36 are the same structure, which is conducive to a reduction of the production cost. However, it is not limited to in practice. Furthermore, in principle, the first support 34 links with the second support 36 through one of the first abutting arm 342 and the third abutting arm 344; similarly, the second support 36 links with the first support 34 through one of the second abutting arm 362 and the fourth abutting arm 364.

Figure 22:
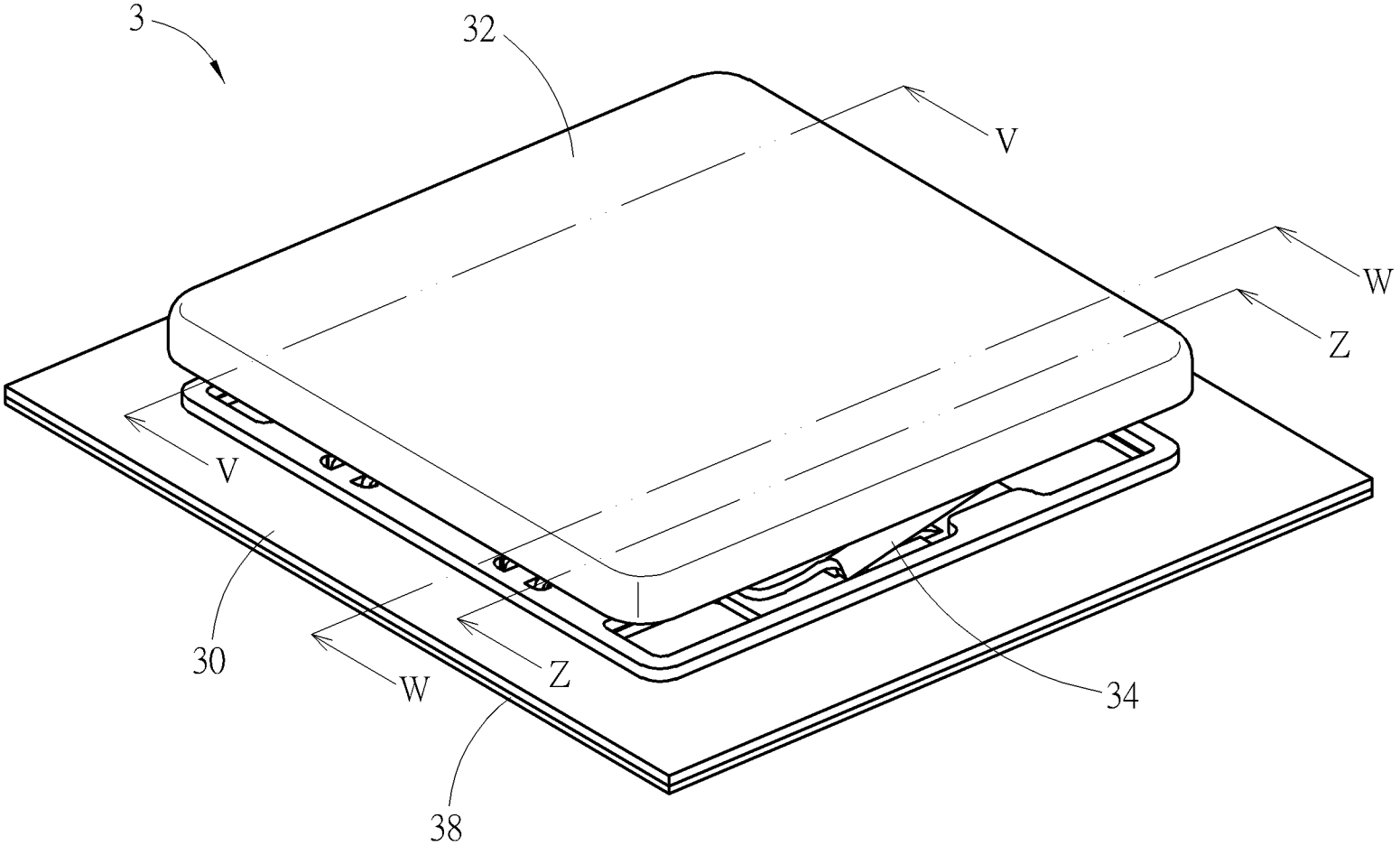
FIG. 22 is a schematic diagram illustrating part of a keyswitch structure according to another embodiment.
Figure 23:
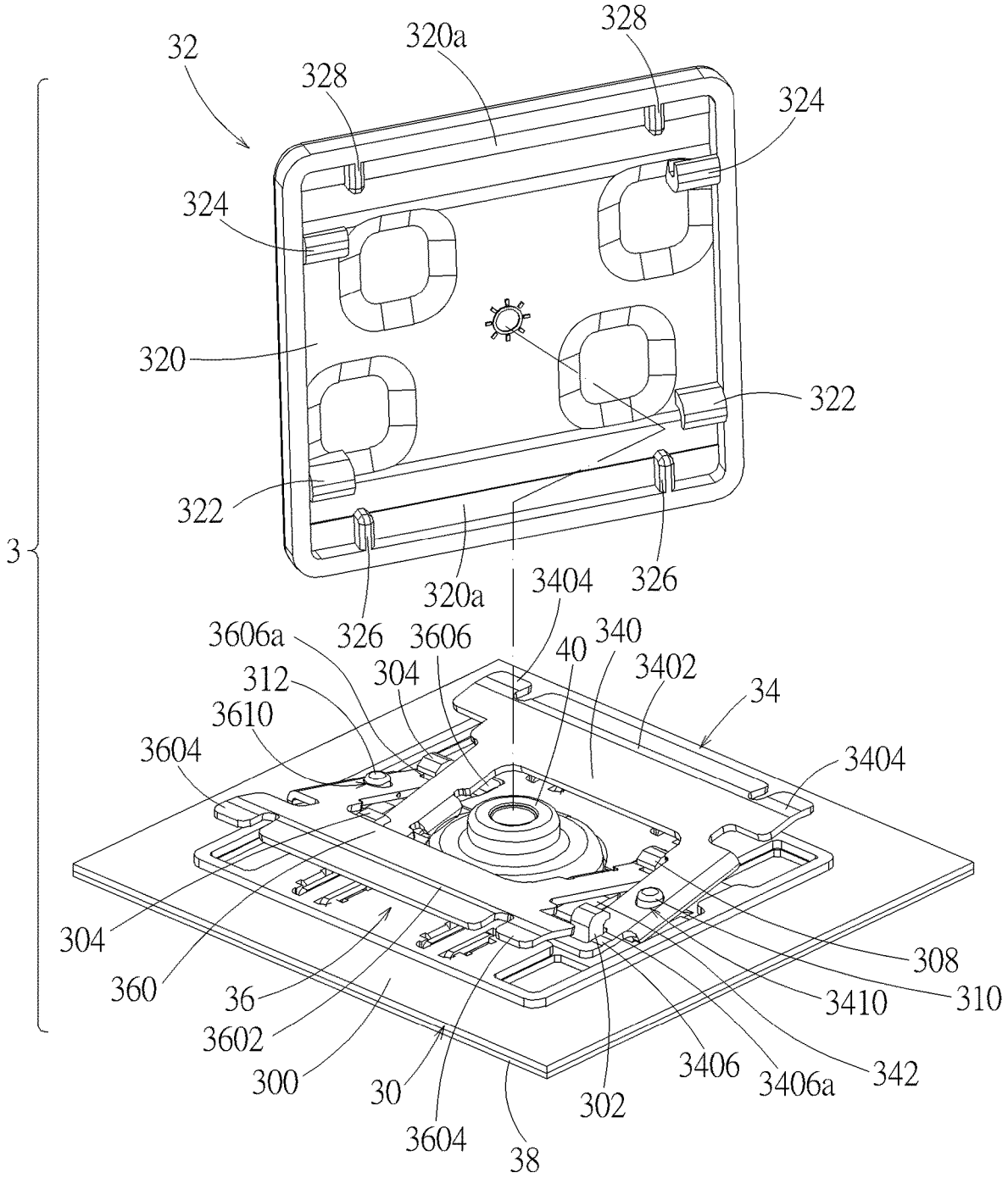
FIG. 23 is a partially exploded view of the keyswitch structure in FIG. 22.
Figure 24:
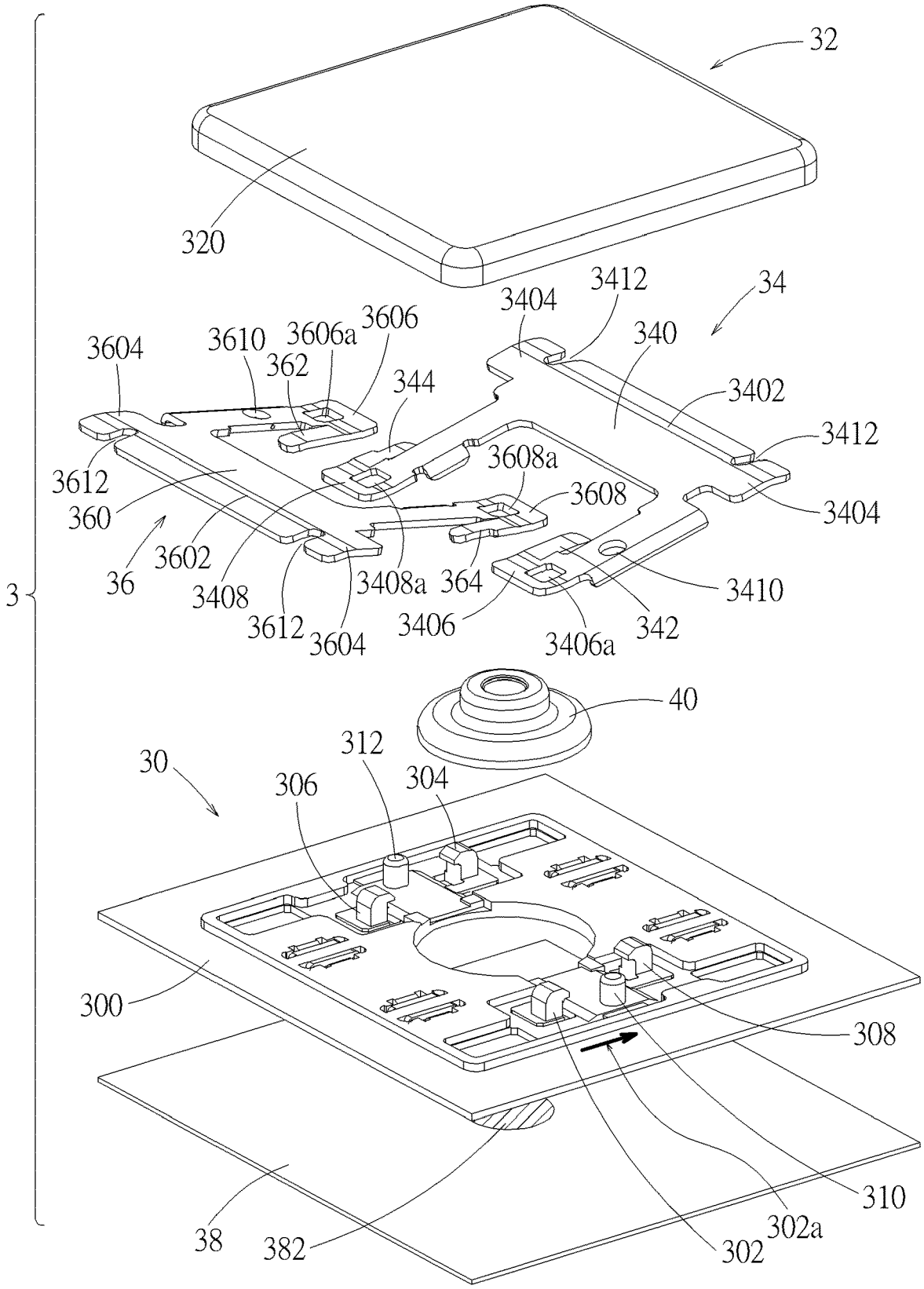
FIG. 24 is an exploded view of the keyswitch structure in FIG. 22.

Furthermore, please refer to FIG. 22 to FIG. 24. In the embodiment, the first base plate abutting portion 3406 has a first through hole 3406*a*. The third base plate abutting portion 3408 has a third through hole 3408*a*. The first hook 302 and the third hook 306 extend into the first through hole 3406*a* and the third through hole 3408*a* respectively, and hook hole edges of the first through hole 3406*a* and the third through hole 3408*a* for the achievement of hooking the first base plate abutting portion 3406 and the third base plate abutting portion 3408. The second base plate abutting portion 3606 has a second through hole 3606*a*. The fourth base plate abutting portion 3608 has a fourth through hole 3608*a*. The second hook 304 and the fourth hook 308 extend into the second through hole 3606*a* and the fourth through hole 3608*a* respectively, and hook the hole edges of the second through hole 3606*a* and the fourth through hole 3608*a* for the achievement of hooking the second base plate abutting portion 3606 and the fourth base plate abutting portion 3608. However, it is not limited thereto in practice. For example, the first hook 302 and the third hook 306 directly hook outer edges of the first base plate abutting portion 3406 (or hook indentations formed there). The second hook 304 and the fourth hook 308 has similar structural configuration as the above, which will not be described in addition.

Figure 28:
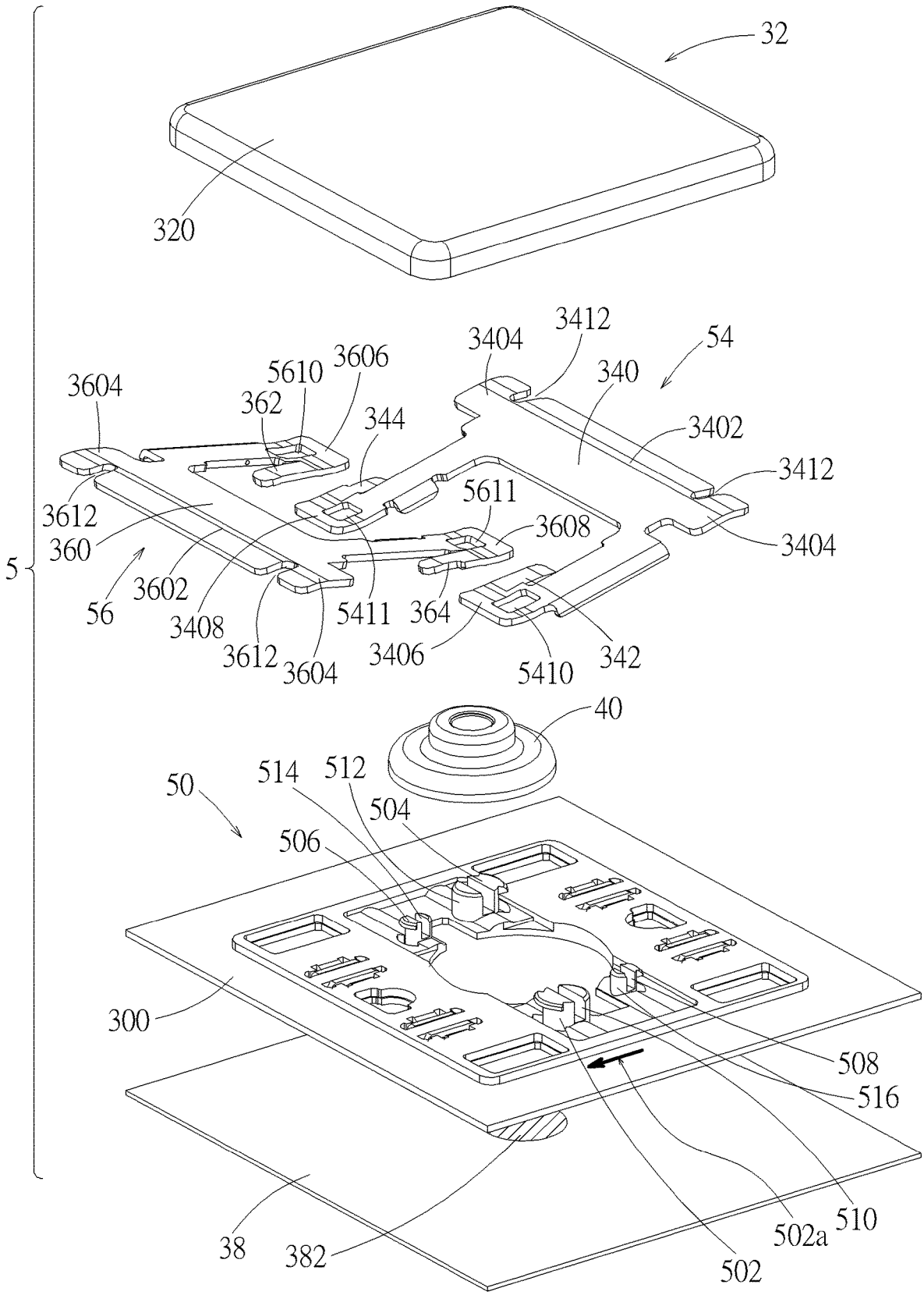
FIG. 28 is an exploded view of a keyswitch structure according to another embodiment.

Furthermore, in the embodiment, the first hook 302 has an opening direction 302*a*. The first limitation post 310 is disposed at a side of the first hook 302 in the opening direction 302*a*. The second hook 304 has similar structural configuration as the above, which will not be described in addition. In practice, the first through hole 3406*a* can be structurally integrated with the first limitation hole 3410. As shown by FIG. 28, a keyswitch structure 5 according to an embodiment is structurally similar to the keyswitch structure 3, so the keyswitch structure 5 continues using the reference numbers of the keyswitch structure 3. For other descriptions about the keyswitch structure 5 and variant thereof, please refer to the relevant descriptions of the keyswitch structure 3, which will not be described in addition. In the keyswitch structure 5, a base plate 50 includes a first hook 502, a second hook 504, a third hook 506, a fourth hook 508, a first limitation post 510, a second limitation post 512, a third limitation post 514, and a fourth limitation post 516. The first limitation post 510, the second limitation post 512, the third limitation post 514, and the fourth limitation post 516 are disposed close to the first hook 502, the second hook 504, the third hook 506, and the fourth hook 508 respectively. Therein, the first hook 502 has an opening direction 502*a*. The first limitation post 510 is disposed at a side of the first hook 502 in a direction opposite to the opening direction 502*a*. The structural configuration of the other components is the same as the above and will not be described in addition.

Furthermore, a first support 54 of the keyswitch structure 5 includes a first limitation hole 5410 and a third limitation hole 5411 which are formed on the first base plate abutting portion 3406 and the third base plate abutting portion 3408 respectively. The first hook 502 and the first limitation post 510 extend into the first limitation hole 5410. The third hook 506 and the third limitation post 514 extend into the third limitation hole 5411. A second support 56 of the keyswitch structure 5 includes a second limitation hole 5610 and a fourth limitation hole 5611 which are formed on the second base plate abutting portion 3606 and the fourth base plate abutting portion 3608 respectively. The second hook 504 and the second limitation post 512 extend into the second limitation hole 5610. The fourth hook 508 and the fourth limitation post 516 extend into the fourth limitation hole 5611.

In addition, in the foregoing about the keyswitch structure 1, the connection structures of the first support 14 and the second support 16 with the keycap 12 also can be applied to the keyswitch structure 3, which will not be described in addition. Similarly, the connection structures of the first support 34 and the second support 36 with the keycap 32 also can be applied to the keyswitch structure 1, which also will not be described in addition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure, comprising:

a base plate, comprising a first hook, a first limitation post, a second hook, and a second limitation post;

a keycap, disposed above the base plate;

a first support, comprising a first support body and a first abutting arm extending from the first support body, the first support being connected to and between the keycap and the base plate through the first support body, the first support body having a first base plate abutting portion and a first limitation hole, the first base plate abutting portion abutting against the base plate, the first support body being rotatable relative to the base plate through the first base plate abutting portion, the first hook hooking the first base plate abutting portion, the first limitation post extending into the first limitation hole; and a second support, comprising a second support body and a second abutting arm extending from the second support body, the second support body being connected to and between the keycap and the base plate through the second support body, the second support body having a second base plate abutting portion and a second limitation hole, the second base plate abutting portion abutting against the base plate, the second support body is rotatable relative to the base plate through the second base plate abutting portion, the second hook hooking the second base plate abutting portion, the second limitation post extending into the second limitation hole, the first abutting arm being located between the second support body and the base plate and abutting against the second support body, the second abutting arm being located between the first support body and the base plate and abutting against the first support body.

2. The keyswitch structure according to claim 1, wherein the first base plate abutting portion is located at an end portion of the first support body, the first abutting arm extends from the first base plate abutting portion, the second base plate abutting portion is located at an end portion of the second support body, and the second abutting arm extends from the second base plate abutting portion.

3. The keyswitch structure according to claim 2, wherein the first support body shows a first n-shaped structure and has a third base plate abutting portion abutting against the base plate, the first base plate abutting portion and the third base plate abutting portion are located at two end portions of the first n-shaped structure, the first support comprises a third abutting arm extending from the third base plate abutting portion, and the third abutting arm is located between the second support body and the base plate and abuts against the second support body.

4. The keyswitch structure according to claim 3, wherein the second support body shows a second n-shaped structure and has a fourth base plate abutting portion abutting against the base plate, the second base plate abutting portion and the fourth base plate abutting portion are located at two end portions of the second n-shaped structure, the second support comprises a fourth abutting arm extending from the fourth base plate abutting portion, and the fourth abutting arm is located between the first support body and the base plate and abuts against the first support body.

5. The keyswitch structure according to claim 4, wherein the first support and the second support are the same in structure.

6. The keyswitch structure according to claim 4, wherein the first n-shaped structure and the second n-shaped structure are staggered.

7. The keyswitch structure according to claim 3, wherein the base plate comprises a third hook that hooks the third base plate abutting portion.

8. The keyswitch structure according to claim 1, wherein the first base plate abutting portion has a through hole, and the first hook extends into the through hole.

9. The keyswitch structure according to claim 8, wherein the first hook has an opening direction, and the first limitation post is disposed at a side of the first hook in the opening direction.

10. The keyswitch structure according to claim 1, wherein the first limitation hole is located on the first base plate abutting portion, and the first hook extends into the first limitation hole.

11. The keyswitch structure according to claim 10, wherein the first hook has an opening direction, and the first limitation post is disposed at a side of the first hook in a direction opposite to the opening direction.

12. The keyswitch structure according to claim 1, wherein the base plate comprises a metal plate and a plastic part fitted with each other, and the plastic part forms the first hook, the first limitation post, the second hook, and the second limitation post.

13. The keyswitch structure according to claim 1, wherein the keycap comprises a keycap body and a vertical limitation slot disposed on the keycap body, the keycap body has a bottom surface toward the base plate, the vertical limitation slot has a limitation surface opposite to the bottom surface, the first support body comprises a keycap abutting portion and a limitation portion, the keycap abutting portion abuts against the bottom surface, and when the keycap is not pressed, the limitation portion abuts against the limitation surface.

14. The keyswitch structure according to claim 13, wherein the keycap comprises a limitation block disposed on the keycap body, the first support has a horizontal limitation slot, and the limitation block is relatively slidably inserted in the horizontal limitation slot.

* * * * *